US012251034B2

(12) United States Patent
Coyle, Jr. et al.

(10) Patent No.: US 12,251,034 B2
(45) Date of Patent: Mar. 18, 2025

(54) FRAME ASSEMBLY

(71) Applicant: MCS Industries, Inc., Easton, PA (US)

(72) Inventors: Robert Terry Coyle, Jr., Palmer, PA (US); Matthew Scott Kressin, Allentown, PA (US); Geoffrey William Bastian, Easton, PA (US); Michael Lee Pyle, Sugar Grove, IL (US)

(73) Assignee: MCS Industries, Inc., Easton, PA (US)

( * ) Notice: Subject to any disclaimer, the term of this patent is extended or adjusted under 35 U.S.C. 154(b) by 129 days.

(21) Appl. No.: 18/120,492

(22) Filed: Mar. 13, 2023

(65) Prior Publication Data

US 2023/0255368 A1 Aug. 17, 2023

Related U.S. Application Data

(60) Continuation of application No. 17/168,754, filed on Feb. 5, 2021, now Pat. No. 11,617,458, which is a division of application No. 16/284,243, filed on Feb. 25, 2019, now Pat. No. 10,939,774.

(51) Int. Cl.
*A47G 1/06* (2006.01)

(52) U.S. Cl.
CPC .... *A47G 1/0611* (2013.01); *A47G 2001/0666* (2013.01); *A47G 2001/0677* (2013.01); *A47G 2001/0694* (2013.01)

(58) Field of Classification Search
CPC ..... A47G 1/0611; A47G 2001/0666; A47G 2001/0677; A47G 2001/0694
See application file for complete search history.

(56) References Cited

U.S. PATENT DOCUMENTS 2,401,241 A 5/1946 Grobholz
3,654,719 A 4/1972 Rochelt
3,686,783 A 8/1972 Levy
(Continued)

FOREIGN PATENT DOCUMENTS

CA 2089443 8/1994
WO WO 9003753 A 4/1990
(Continued)

OTHER PUBLICATIONS

Etsy Website, https://www.etsy.com/listing/256876602/picture-frame-easel-back-easel-mate, Retrieved Feb. 11, 2019; pp. 1-5.
(Continued)

*Primary Examiner* — Gary C Hoge
(74) *Attorney, Agent, or Firm* — Belles Katz LLC

(57) ABSTRACT

A frame assembly for supporting a flat article. In one aspect, the frame assembly may include a stack including a transparent window panel and a frame. The frame may include a floor structure for supporting the stack and an outer annular wall coupled to and surrounding the floor structure, the outer annular wall including a plurality of corners, an outer surface defining a periphery of the frame, an inner surface defining a display cavity, and a front edge that defines a display opening configured to allow the stack to pass therethrough into the display cavity. The outer annular wall may have a non-uniform thickness. The corner portions may have lower and upper portions, with the lower portions having a greater thickness than the lower portions.

21 Claims, 23 Drawing Sheets

(56) References Cited

U.S. PATENT DOCUMENTS

| | | | | |
|---|---|---|---|---|
| 3,771,244 | A | 11/1973 | Ebner | |
| 3,908,955 | A | 9/1975 | Frechtman | |
| D241,292 | S | 9/1976 | Weiss | |
| 3,990,670 | A | 11/1976 | Frechtman | |
| 4,058,283 | A | 11/1977 | Frechtman | |
| 4,199,126 | A | 4/1980 | Komendowski | |
| 4,216,597 | A | 8/1980 | Kocina et al. | |
| 4,432,152 | A | 2/1984 | Daenen | |
| 4,509,712 | A | 4/1985 | Moller | |
| 4,515,338 | A | 5/1985 | Schneider | |
| 4,622,767 | A | 11/1986 | Sullivan | |
| 4,776,117 | A | 10/1988 | Astolfi | |
| 4,798,015 | A * | 1/1989 | Ackeret | G02B 27/022 40/724 |
| 4,871,140 | A | 10/1989 | Hoskinson et al. | |
| 5,018,291 | A | 5/1991 | Pasquale | |
| 5,253,440 | A * | 10/1993 | Chang | A47G 1/143 40/748 |
| 5,329,712 | A | 7/1994 | Keller | |
| 5,735,068 | A | 4/1998 | Houssian | |
| 5,974,714 | A | 11/1999 | Jones | |
| D423,794 | S | 5/2000 | Brownfield | |
| 6,405,466 | B1 | 6/2002 | Lemire | |
| D476,818 | S | 7/2003 | Stravitz | |
| 6,694,656 | B2 * | 2/2004 | Flodin | A47G 1/143 40/748 |
| D503,542 | S | 4/2005 | Chen | |
| D569,630 | S * | 5/2008 | Bradford | D6/310 |
| 7,484,326 | B2 | 2/2009 | Tamura et al. | |
| D641,175 | S | 7/2011 | Tang | |
| 8,011,510 | B1 | 9/2011 | Smith, II et al. | |
| D839,001 | S | 1/2019 | Berrios | |
| 10,624,473 | B1 | 4/2020 | Tsai | |
| 10,939,774 | B2 * | 3/2021 | Coyle, Jr. | A47G 1/06 |
| D916,470 | S | 4/2021 | Fallander | |
| 11,178,985 | B2 * | 11/2021 | Bastian | A47G 1/065 |
| D940,470 | S | 1/2022 | Svihilik | |
| D940,471 | S | 1/2022 | Svihilik | |
| 2002/0148151 | A1 * | 10/2002 | Whitlow | A47G 1/06 40/768 |
| 2005/0044767 | A1 | 3/2005 | Lasher | |
| 2007/0084743 | A1 | 4/2007 | Chu et al. | |
| 2007/0215780 | A1 * | 9/2007 | Eichert | A47G 1/162 248/497 |
| 2010/0192437 | A1 | 8/2010 | Fallander | |
| 2012/0090211 | A1 * | 4/2012 | Price | A47G 1/06 40/711 |
| 2013/0247401 | A1 | 9/2013 | Miller | |
| 2014/0068984 | A1 * | 3/2014 | Mochel | A47G 1/06 40/757 |
| 2015/0320240 | A1 * | 11/2015 | Michel | G11B 33/0422 40/745 |
| 2016/0088957 | A1 * | 3/2016 | Makrakis | A47G 1/06 40/711 |
| 2017/0035221 | A1 * | 2/2017 | Huff | A47G 1/0605 |
| 2018/0199736 | A1 * | 7/2018 | Spiro | A47G 1/101 |
| 2019/0350387 | A1 * | 11/2019 | Bastian | A47G 1/1626 |

FOREIGN PATENT DOCUMENTS

| | | |
|---|---|---|
| WO | WO 2004098354 | 11/2004 |
| WO | WO 2007008865 | 1/2007 |

OTHER PUBLICATIONS

MCS Frames Website via The Wayback Machine "Format Frames" https://web.archive.org/web/20081201062345/http://www.mcsframes.com:80/frames_format.html; Date First Available Dec. 1, 2008.

Amazon Website via The Wayback Machine "MCS 11x17 Inch Format Frame, Black (40962)" https://web.archive.org/web/20190218021020/https://www.amazon.com/MCS-11x17-Format-Frame- 40962/dp/B00AWGIF4A; Date First Available Sep. 21, 2011; pp. 1-8.

Youtube Website; MCS Industries "Format Frame Easel Assembly " https://www.youtube.com/watch?v=mKF6Kf_FtRc; Date First Available Jun. 4, 2014.

Youtube Website; Vic Marvey "How To Use An MCS Front Loading Picture Frame" https://www.youtube.com/watch?v=wzx9FR2ATh8; Date First Available May 24, 2016.

Youtube Website; Good Night "Mcs 8.5 x 11 Inch Format Frame 6-Pack Review "https://www.youtube.com/watch?v=uj-cLZWbv-M&list=PLsWgMpC9n71xX1uUIDNyBSyDdPVBixTSm&index=11; Date First Available Jan. 4, 2018; pp. 1-2.

Amazon Website "Frame Amo Black 20x26 Picture or Poster Frame, 1 inch Wide Border, Smooth Finish, Acrylic Front" https://tinyurl.com/235ar5nu; Date First Available Mar. 12, 2006; pp. 1-9.

* cited by examiner

FRAME ASSEMBLY

CROSS-REFERENCE TO RELATED APPLICATIONS

The present application is a continuation of U.S. patent application Ser. No. 17/168,754, filed Feb. 5, 2021, which is a divisional of U.S. patent application Ser. No. 16/284,243, filed Feb. 25, 2019, the entireties of which are incorporated herein by reference.

FIELD OF THE INVENTION

The present invention relates generally to frames, and specifically to frame assemblies for displaying an article.

BACKGROUND OF THE INVENTION

People enjoy commemorating their achievements or memorializing a particular life event by placing an article such as a picture, a diploma, a certificate, or the like in a frame and displaying the frame in a home or business. People also enjoy keeping framed photographs of family and friends around their homes to create a desired atmosphere within the home. Different flat articles that people desire to frame are required to be oriented differently depending on whether the flat article is oriented as a landscape or portrait for normal viewing. Frames can be utilized as free-standing frames such that the frame can stand on its own when positioned on a horizontal surface, or frames can be leaned against or hung from a wall or other vertical surface. Conventional free standing frames use a pivotable support that is integrally formed with a backer board to support the frame on the horizontal surface. The use of the support requires the frame to take up a significant amount of space on the horizontal surface and may make it difficult to transition between landscape and portrait display. Such backer boards may also increase the cost of the frame. Thus, a need exists for an improved frame assembly that is capable of being hung on a wall or displayed in a free-standing manner while reducing manufacturing costs.

SUMMARY OF THE INVENTION

Exemplary embodiments according to the present disclosure are directed to a frame assembly for displaying a flat article. The frame assembly generally comprises a frame and a stack which includes a window panel that is supported by the frame. The frame may comprise a floor structure, an outer annular wall coupled to and surrounding the floor structure, and a locking feature on the outer annular wall. The stack is positioned in a display cavity of the frame such that the locking feature snap-locks the stack within the display cavity.

In one aspect, the invention can be a frame assembly for displaying a flat article, the frame assembly comprising: a stack comprising a transparent window panel; a frame comprising: a floor structure for supporting the stack, the floor structure comprising a floor having an inner edge and an outer edge and an inner annular wall extending upwardly from the inner edge of the floor to a top edge of the inner annular wall, the stack being positioned atop of and in contact with the top edge of the inner annular wall; and an outer annular wall extending from the outer edge of the floor, the outer annular wall comprising an outer surface defining a periphery of the frame, an inner surface defining a display cavity, and a front edge that defines a display opening wherein the stack is configured to be positioned within the display cavity via the display opening; and wherein the outer annular wall comprises a thickness measured between the inner and outer surfaces of the outer annular wall, and wherein the thickness of the outer annular wall is non-uniform.

In another aspect, the invention can be a frame assembly for displaying a flat article, the frame assembly comprising: a frame comprising: a floor structure for comprising a floor having an inner edge and an outer edge and an inner annular wall extending upwardly from the inner edge of the floor and terminating at a top edge; and an outer annular wall extending upwardly from the outer edge of the floor and terminating at a front edge, the outer annular wall comprising an outer surface defining a periphery of the frame and an inner surface defining a display cavity; and wherein the outer annular wall comprises a plurality of corner portions each comprising a corner of the outer annular wall and a plurality of side portions each extending between two of the corner portions; wherein, along at least one of the corner portions, the outer annular wall comprises a lower portion adjacent to the floor of the floor structure and an upper portion adjacent to the front edge of the outer annular wall, the lower portion having a first thickness and the upper portion having a second thickness, the first thickness being greater than the second thickness.

In yet another aspect, the invention can be a frame assembly for displaying a flat article, the frame assembly comprising: a frame comprising: a floor structure comprising a floor having an inner edge and an outer edge and an inner annular wall extending upwardly from the inner edge of the floor; and an outer annular wall extending upwardly from the outer edge of the floor, the outer annular wall comprising an outer surface defining a periphery of the frame and an inner surface defining a display cavity; and wherein the outer annular wall comprises a plurality of corner portions each comprising a corner of the outer annular wall and a plurality of side portions each extending between two of the corner portions; and wherein the inner surface of the outer annular wall comprises a shoulder located at each intersection between one of the plurality of corner portions and one of the plurality of side portions.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will be described in detail below with respect to the drawings, in which.

DETAILED DESCRIPTION OF THE INVENTION

Figure 1:
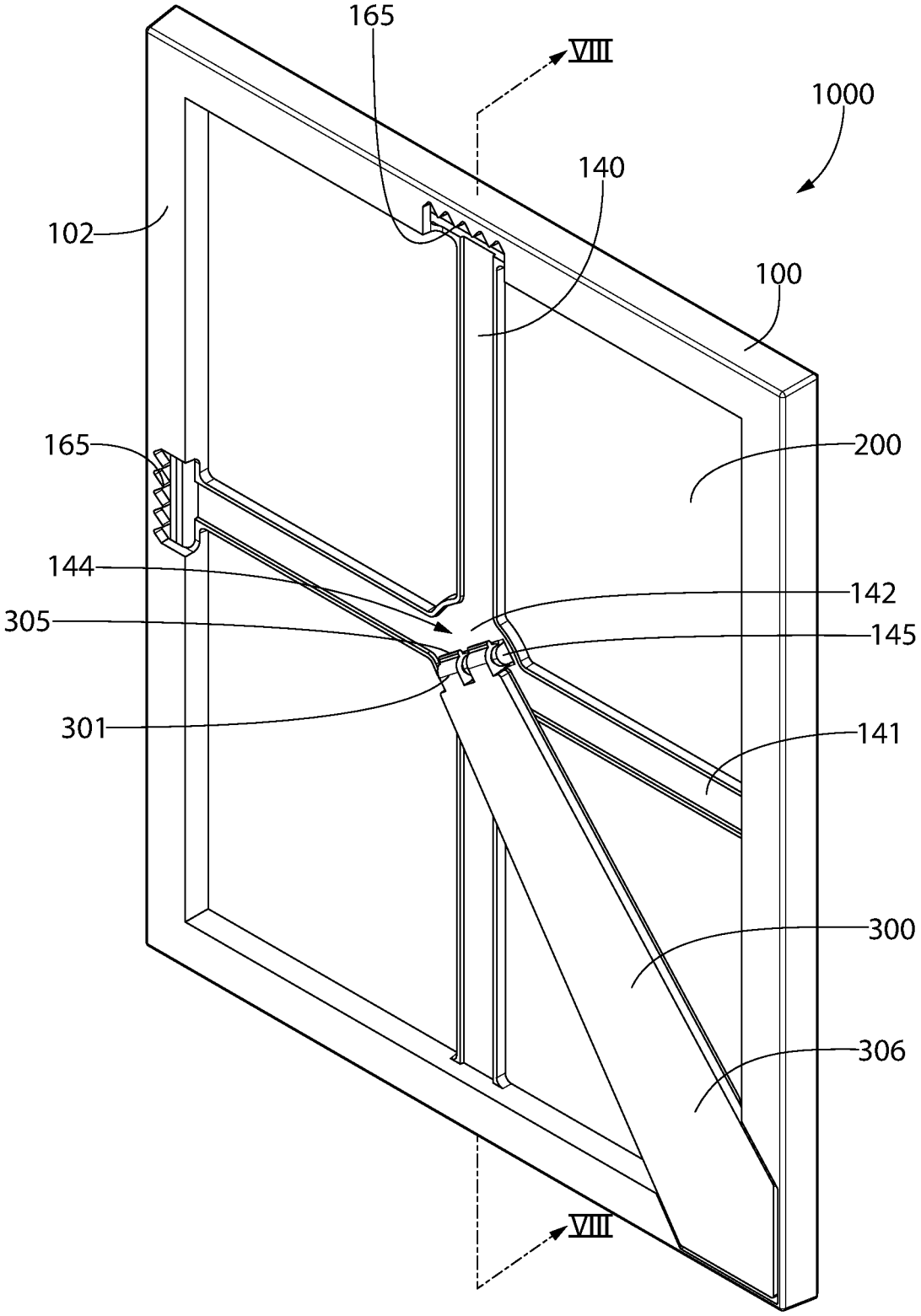
FIG. 1 is a rear perspective view of a frame assembly in accordance with a first embodiment of the present invention, wherein an easel of the frame assembly is in a storage position.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Further, the term "overlayed" and "overlying" refer to a relationship in which one layer is applied over another layer and/or structure, either directly or indirectly through the presence of intervening layers and/or structures. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Figure 2:
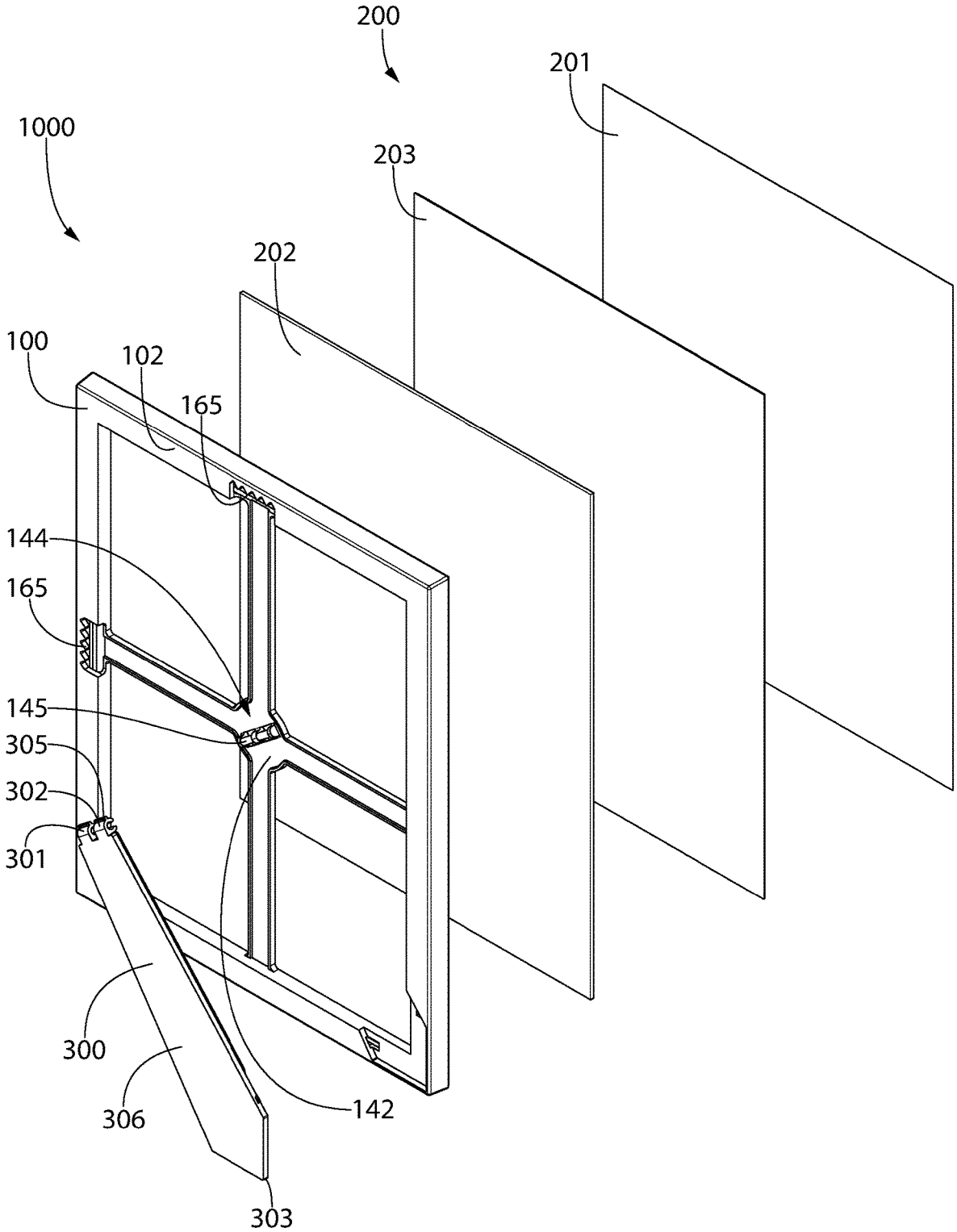
FIG. 2 is an exploded view of the frame assembly of FIG. 1.

Referring to FIGS. 1 and 2 concurrently, a frame assembly 1000 is illustrated in accordance with an embodiment of the present invention. The frame assembly 1000 generally comprises a frame 100, a stack 200, and an easel 300. The frame 100, which may be an integrally formed monolithic structure, is intended to retain and hold the items of the stack 200 for display. The stack 200 may comprise a transparent window panel 201, a backer panel 202, and a display article 203 that is intended to be displayed. In some embodiments the stack 200 may include only the transparent window panel 201 and the display article 203 such that the backer panel 202 may be omitted in some embodiments.

The frame 100 is a structural component that is intended to be free-standing on a horizontal support surface, such as a desk or table, so that the display article 203 retained therein can be displayed for viewing. The frame 100 may alternatively be hung from a vertical support surface such as a wall for displaying the display article 203. The frame 100 also protects the display article 203 against damage so that the integrity and pristine condition of the display article 203 can be maintained even while displaying the display article 203 for viewing. Specifically, during display the display article 203 may be sandwiched between the window panel 201 and the backer panel 202. Furthermore, each of the window panel 201 and the backer panel 202 is retained by the frame 100 as discussed in more detail below. Examples of display articles 203 that may be included in the stack 200 include, without limitation, a picture, artwork, a painting, a drawing, a poster, a diploma, a photograph, a puzzle, a newspaper, a magazine, other flat articles, or any other item that a user desires to display. Unless specifically recited in the claims, the present invention is not to be limited in any manner by the type of display article to be displayed therein.

The window panel 201 can be any type of glazing that is commonly used for framing. In certain embodiments, the window panel 201 may be a panel of glass, acrylic, plexiglass, polystyrene or other material that allows the viewing of the display article 203 therethrough. Of course, other materials can be used for the window panel 201 in other embodiments of the invention. In some embodiments, the window panel 201 may have a thickness of approximately 2 mm. In certain embodiments, when the frame assembly 1000 is fully assembled the window panel 201 is positioned atop of the display article 203. Thus, the viewer must be able to see through the window panel 201 in order to view the display article 203. In this regard, it is preferable that the window panel 201 be colorless and transparent or formed of a transparent material, although this is not required and in certain other embodiments the window panel 201 may be translucent and/or have a slight colored tint to create a desired aesthetic. In certain embodiments, as used herein the term "transparent" may include the presence of colored tint. In other embodiments, the window panel 201 may be at least partially translucent. The window panel 201 provides protection to the front surface of the display article 203 being displayed while still permitting a viewer to see the display article 203 within the frame assembly 1000. However, it should be appreciated that in certain other embodiments, the window panel 201 may be omitted from the frame assembly 100.

The backer panel 202 can be formed of any type of material desired. Specifically, the backer panel 202 may be formed of a hard or soft plastic material, such as thermoplastics including without limitation polymers and copolymers of styrene (i.e., polystyrene), ethylene, propylene (i.e., polypropylene), olefins, butadiene, vinyl compounds and polyesters, such as polyethylene terephthalate. In other embodiments the backer panel 202 may be formed of a paper or cardboard material. In still other embodiments the backer panel 202 may be formed of wood, metal or any other material as desired. The backer panel 202 may be formed of a cardboard having a thickness of 15 to 35 mils, or more specifically 24 to 30 mils. The backer panel 202 serves to protect the rear surface of the display article 203 against damage while the display article 203 is displayed by or retained within the frame 100. In certain embodiments, the backer panel 202 may be altogether omitted if desired.

In the exemplified embodiment each of the window panel 201 and the backer panel 202 is square or rectangular in shape. However, the invention is not to be so limited and the window panel 201 and the backer panel 202 can take on any desired shape. In certain embodiments it is merely preferred that the window panel 201 and the backer panel 202 have the same shape as a display opening of the frame 100, which will be discussed in more detail below.

Referring to FIGS. 1-4, the frame assembly 1000 will be further described. The frame 100 may be formed as an integral and monolithic structure in some embodiments such that all of the components of the frame 100 discussed herein below are formed together as a single unitary structure. This can be accomplished via an injection molding technique, extrusion, or any other desired manner. Of course, the invention is not to be so limited and in other embodiments the various components of the frame 100 may be separately formed and coupled together during a later stage in the manufacturing process via adhesion, fasteners, welding or the like. The frame 100 may be formed of any desirable material, including without limitation polystyrene such as high impact molding grade polystyrene (such as that having a density of 1.06 g/cm$^3$), other hard plastics including polyethylene, polyvinyl chloride, nylon, thermoplastics, elastomers or the like. In still other embodiments the frame 100 may be formed of wood, metal or other similar materials.

The frame 100 generally comprises a floor structure 110 and an outer annular wall 120 coupled to and surrounding the floor structure 110. The outer annular wall 120 comprises an outer surface 121 that defines a periphery of the frame 100, an inner surface 122 that defines a display cavity 123, a rear edge 124 that is coupled to the floor structure 110, and a front edge 125 that defines a display opening 126. The floor structure 110 generally comprises a floor 111 extending inward from the outer annular wall 120 and an inner annular wall 112 protruding from the floor 111 and into the display cavity 123. The inner annular wall 112 terminates at a top edge 119. The inner annular wall 112 is spaced apart from the outer annular wall 120 by an annular gap 113. The outer annular wall 120 surrounds the annular gap 113 and the annular gap 113 surrounds the inner annular wall 112.

In the exemplified embodiment, the frame 100 is a front-loading type frame, which means that the stack 200 is inserted into the display cavity 123 via an opening in the front side of the frame 100, which is the same side that is displayed during use. Most conventional frames are rear loading frames whereby the window panel is inserted into the display cavity first, followed by the display article and then the backer. This is because these components are inserted into the display cavity through the rear side (i.e., non-display side) of the frame. The inventive frame is different in that the stack 200 is inserted into the display cavity 123 with the backer panel 202 first, followed by the display article 203 and then the window panel 201. This is because the components of the stack 200 are inserted into the display cavity through the front side (i.e., display side) of the frame 100. Thus, a front-loading frame is one in where the stack 200 is loaded into the frame 100 through the front, or display, side of the frame 100.

As noted above, the outer annular wall 120 comprises the outer surface 121 which defines a periphery of the frame 100. Thus, the outer annular wall 120 dictates the shape of the frame 100. In the exemplified embodiment, the frame 100 has a square or rectangular shape. However, the invention is not to be so limited in all embodiments and in certain other embodiments the frame 100 may have any other shape including circular, triangular, pentagonal, hexagonal, heptagonal, octagonal, nonagonal, decagonal, hendecagonal, dodecagonal or the like.

Furthermore, in the exemplified embodiment the front edge 125 of the outer annular wall 120 defines the display opening 126 of the frame 100, which is the opening through which the stack 200 is inserted into the display cavity 123. The display opening 126 is sized, shaped and configured so that the stack 200 can pass through the display opening 126 and into the display cavity 123. Thus, the frame 100 is a front-loading frame such that the stack 200 including the window panel 201 can be inserted into the display cavity 123 through the display opening 126 formed by the front edge 125 of the outer annular wall 120. Once inserted into the display opening 126, the stack 200 is retained in place by a combination of the floor structure 110 and a locking feature 150, which will be described in more detail below.

In the exemplified embodiment the display opening 126 is square or rectangular in shape but it can take on any of the polygonal shapes noted above as necessary to display a display article having any shape desired. Alternatively, the display opening 126 may be circular in shape. The shape of the window panel 201 and the backer panel 202 of the stack 200 can be modified depending on the shape of the display article 203 and the shape of the display opening 126. The display opening 126 need not have the same shape as the periphery of the frame 100 in all embodiments, and in certain embodiments the periphery of the frame 100 may be any polygonal shape while the display opening 126 may be circular or a different polygonal shape.

The frame 100 also comprises a first reinforcement member 140 connected to two opposing sides of the inner annular wall 110 and a second reinforcement member 141 connected to two other opposing sides of the inner annular wall 110. Each of the first and second reinforcement members 140, 141 extends across the display cavity 123. Furthermore, the first and second reinforcement members 140, 141 intersect at a central reinforcement region 142. The central reinforcement region 142 comprises a front surface 143 that faces the display cavity 123 and a rear surface 144 opposite the front surface 143. The first and second reinforcement members 140, 141 as well as the central reinforcement region 142 serve to provide some additional structural rigidity to the frame 100. Furthermore, in the exemplified embodiment the easel 300 is coupled to the frame 100 at the central reinforcement region 142 and thus the central reinforcement region 142 provides a location for the attachment of the easel 300 to the frame 100.

When assembled, the stack 200 rests atop the top edge 119 of the inner annular wall 110. Furthermore, the stack 200 may also rest atop the first and second reinforcement members 140, 141 and the central reinforcement region 142. In the exemplified embodiment, the backer board 202 rests directly atop the top edge 119 of the inner annular wall 110, but the backer board 202 may be omitted in which case the display article 203 may rest atop the top edge 119 of the inner annular wall 110. In any event, the outer annular wall 120 surrounds a peripheral edge of the stack 200 when the stack 200 is assembled in the display cavity 123 of the frame 100.

In the exemplified embodiment, the easel 300 is detachably coupled to the frame 100. More specifically, the frame 100 comprises a first mounting element 145 extending from the rear surface 144 of the central reinforcement region 142 and the easel 300 comprises a second mounting element 301. The first and second mounting elements 145, 301 mate with one another to couple the easel 300 to the frame 100. In the exemplified embodiment, the first mounting element 145 is a rod-shaped member and the second mounting element 301 is a C-shaped member having a cavity for receiving the rod-shaped member. Thus, the rod-shaped member of the first mounting element 145 is inserted into the cavity of the C-shaped member of the second mounting element 301 to couple the easel 300 to the frame 100. Of course, the first mounting element 145 may be the C-shaped member while the second mounting element 301 is the rod-shaped member in other embodiments. Furthermore, the first and second mounting elements 145, 301 may take on other structures different than that which is depicted in the exemplified embodiment so long as the mating of the first and second mounting elements 145, 301 permits a pivotable coupling of the easel 300 to the frame 100 as described herein.

The configuration of the first and second mounting elements 145, 301 pivotably couples the easel 300 to the frame 100 so that the easel 300 can be pivoted between a storage position and a use position as described further herein below. In the exemplified embodiment, the easel 300 is detachably coupled to the frame 100 such that with sufficient force the easel 300 can be separated completely from the frame 100. In other embodiments, the easel 300 may be permanently attached to the frame 100 using various techniques known in the art.

The easel 300 comprises a proximal end 302, which is the end that couples to the frame 100, and a distal end 303, which is the end that is configured to support the frame assembly 1000 on a support surface such as a desk, floor, shelf, or the like. Furthermore, the easel 300 comprises a front surface 306 and a rear surface 307 opposite the front surface 306. The rear surface 307 of the easel 300 is the surface that faces the frame 100 and the front surface 306 of the easel 300 faces away from the frame 100. In the exemplified embodiment, the easel 300 comprises a stopper tab 302 extending from the proximal end 302. The stopper tab 305 is configured to prevent over-rotation of the easel 300 relative to the frame 100. Specifically, as the easel 300 is rotated from a storage position (FIG. 1) to a use position (FIG. 5), the stopper tab 305 will contact the rear surface 144 of the central reinforcement region 142 to prevent further rotation of the easel 300.

The outer annular wall 120 comprises a first wall portion 127, a second wall portion 128, a third wall portion 129, and a fourth wall portion 130. The first and third wall portions 127, 129 are opposite to one another and the second and fourth wall portions 128, 130 are opposite to one another. In the exemplified embodiment the outer annular wall 120 comprises four wall portions because the outer annular wall 120 is in the shape of a square or rectangle. Of course, the outer annular wall 120 can take on other shapes, such as being any polygonal shape, in which case the number of sides (i.e., wall portions) of the outer annular wall 120 will be modified accordingly.

As noted above, the frame 100 also comprises a locking feature 150. The locking feature 150 is located on the inner surface 122 of the outer annular wall 120. In the exemplified embodiment, the locking feature 150 is a protrusion or tab extending from the inner surface 122 of the outer annular wall 120 inwardly towards the display cavity 123. More specifically, in the exemplified embodiment the locking feature 150 comprises a first tab 151*a* located on the inner surface 122 of the first wall portion 127 of the outer annular wall 120 and extending into the display cavity 123, a second tab 151*b* located on the inner surface 122 of the second wall portion 128 of the outer annular wall 120 and extending into the display cavity 123, a third tab 151*c* located on the inner surface 122 of the fourth wall portion 129 of the outer annular wall 120 and extending into the display cavity 123 and a fourth tab 151*d* located on the inner surface 122 of the fourth wall portion 130 of the outer annular wall 120 and extending into the display cavity 123. In the exemplified embodiment, the locking feature 150 is positioned adjacent the front edge 125 of the outer annular wall 120. In one embodiment, each of the tabs 151*a-d* may be flush with the front edge 125 of the outer annular wall 120, although this is not required in all embodiments.

As noted above, the frame 100 is a front-loading frame such that the stack 200 is inserted into the display cavity 123 through the display opening 126 located at the front edge 125 of the outer annular wall 120. Thus, when it is desired to insert the stack 200 into the display cavity 123, the stack 200 is positioned adjacent the display opening 126 and pressed inwardly towards the display cavity 123. As the stack 200 is pressed inwardly towards the display opening 126, the tabs 151*a-d* of the locking feature contact the stack 200. However, due to the flexibility/resiliency of the outer annular wall 120, the stack 200 is able to be pushed passed the tabs 151*a-d* so as to enter into the display cavity 123.

More specifically, in certain embodiments one or more of the components of the stack 200 has a length and width that is substantially the same as the length and width of the display opening 126 and the display cavity 123. However, the tabs 151*a-d* extend inwardly from the inner surface 122 of the outer annular wall 120 towards the display cavity 123. The distance between opposing ones of the tabs 151*a-d* is less than the length and/or width of the stack 200. Thus, when inserting the stack 200 through the display opening 126, the outer annular wall 120 flexes slightly to permit the stack 200 to enter into the display cavity 123. Once the stack 200 passes by the tabs 151*a-d* of the locking feature 150, the outer annular wall 120 snaps or biases back into its original shape/form, thus snap-locking the stack 200 within the display cavity 123.

Once located within the display cavity 123, the tabs 151*a-d* are positioned adjacent, or in some instances into contact with a front surface of the stack 200 (i.e., a front surface of the window panel 201 of the stack 200). Thus, the locking features 150, and particularly the tabs 151*a-d*, snap-lock the stack 200 within the display cavity 123 to retain the stack 200 within the display cavity 123.

Although the exemplified embodiment depicts the locking feature 150 comprising the locking tabs 151*a-d* extending from the outer annular wall 120 and into the display cavity 123, the invention is not to be so limited in all embodiments. In certain other embodiments, the locking feature 150 may comprise one or more slots or depressions formed into the inner surface 122 of the outer annular wall 120. In such an embodiment, the stack 200, or more specifically the window panel 201 of the stack 200, may include tabs extending from its periphery. Thus, upon inserting the stack 200 through the display opening 126, the tabs of the window panel 201 (or some other component of the stack 200) will be inserted into the slots or depressions formed into the inner surface 122 of the outer annular wall 120.

In still other embodiments, the locking feature 150 may include fasteners that are pivotably or rotatably coupled to the outer annular wall 120. In such an embodiment, the stack 200 can be inserted into the display cavity 123 through the display opening 126 and once positioned within the display cavity 123 the fasteners can be pivoted or rotated so as to prevent the stack 200 from falling out of the display cavity 123. Thus, the fasteners can be pivotable between a first position in which the fasteners extend from the outer annular wall 120 in a manner and direction so as not to block the display opening 126 and a second position in which the fasteners extend from the outer annular wall 120 in a manner and direction so as to block the display opening 126. Furthermore, other features and components can be used as the locking feature 150 within the scope of the present invention as would be understood by person of ordinary skill in the art.

Referring back to the exemplified embodiment, when the stack 200 is positioned within the display cavity 123, the locking feature 150 snap-locks the stack 200 within the display cavity 123. When the stack 200 is positioned within the display cavity 123, the backer panel 202 of the stack 200 is positioned adjacent to the floor structure 110, and more specifically adjacent to the inner annular wall 110. More specifically, the backer panel 202 of the stack 200 is positioned so as to be in surface contact with the upper edge 119 of the inner annular wall 110. Thus, upon being snap-locked into the display cavity 123, the stack 200 is positioned between the tabs 151*a-d* of the locking feature 150 and the upper edge 119 of the inner annular wall 110. In some embodiments, the tabs 151*a-d* of the locking feature 150 are in surface contact with the front surface of the window panel 201 and the upper edge 119 of the inner annular wall 110 is in surface contact with the rear surface of the backer panel 202. Thus, the combination of the floor structure 110, and more specifically the inner annular wall 112 of the floor structure 110 and the locking feature 150 facilitate securely retaining the stack 200 within the display cavity 123. In some embodiments, there may be a small gap between the tabs 151*a-d* of the locking feature 150 and the front surface of the stack 200 while the rear surface of the stack 200 is in contact with the upper edge 119 of the inner annular wall 110 when the stack 200 is retained within the display cavity 123. Nonetheless, the locking feature 150 holds the stack 200 within the display cavity 123 and prevents the stack 200 from being removed therefrom without distinct and forceful user action.

Figure 3:
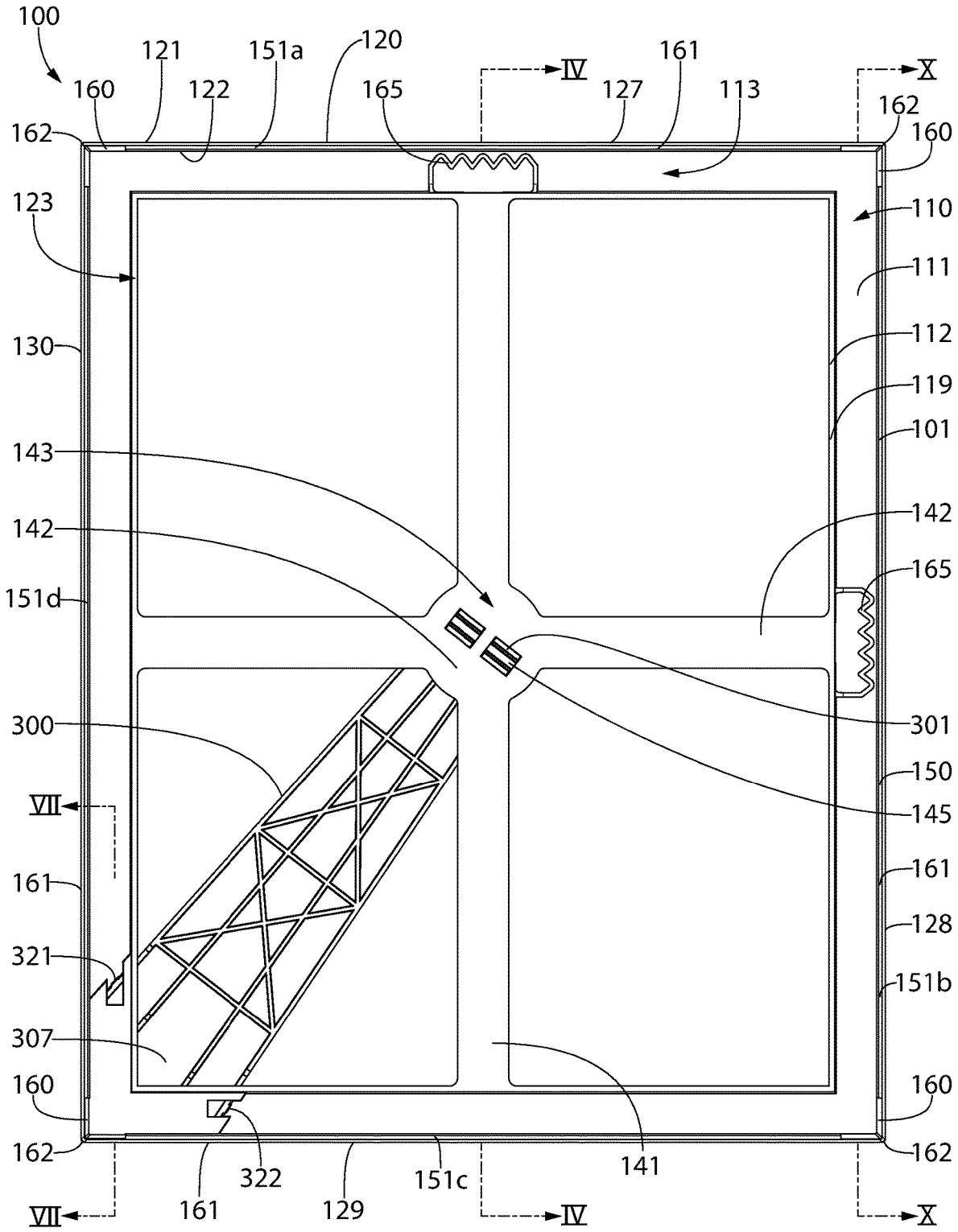
FIG. 3 is a rear perspective view of the frame assembly of FIG. 1 with the easel in a use position.
Figure 4:
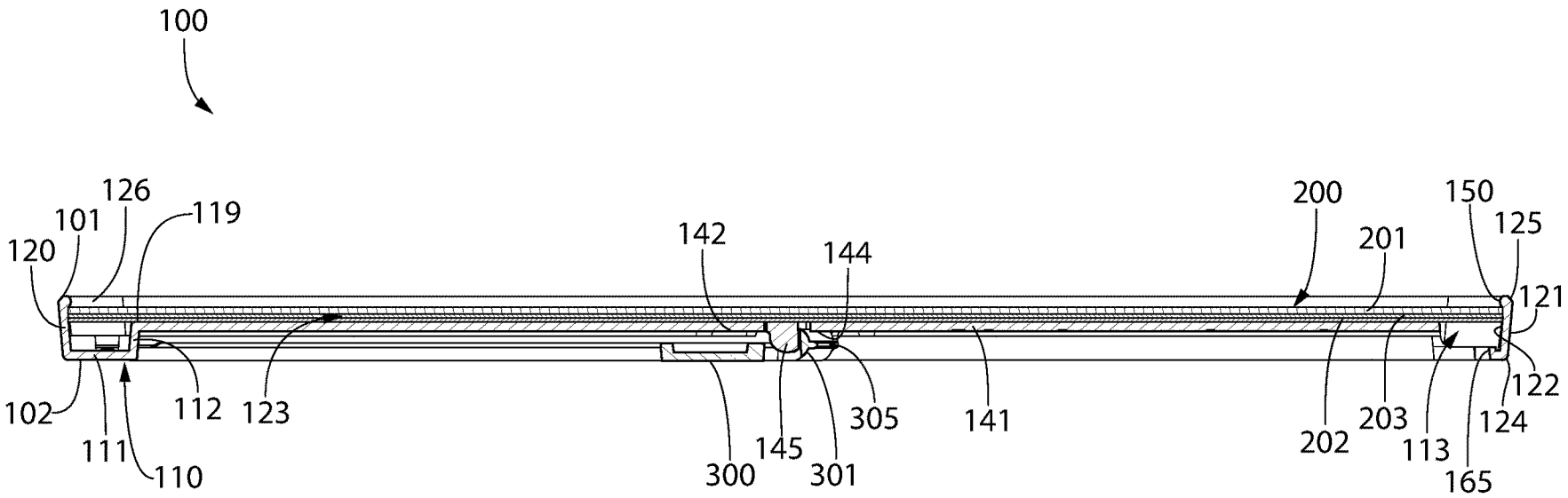
FIG. 4 is a cross-sectional view taken along line IV-IV of FIG. 3, wherein the stack is positioned within a display cavity of the frame.

As best seen in FIG. 3, the outer annular wall 120 comprises a plurality of corner portions 160 and a plurality of side portions 161. Each of the corner portions 160 comprises one of the corners 162 of the outer annular wall 120. Thus, each of the corner portions 160 comprises a portion of the outer annular wall 120 that includes one of the corners 162 and a small portion of two adjacent ones of the wall sections 127-130. Thus, each of the corner portions 160 is an L-shaped portion of the outer annular wall 120 located along one of the corners 162 of the outer annular wall 120. For example, one of the corner portions 160 comprises a portion of the first wall section 127, a portion of the second wall section 128, and the corner 162 that is formed by the intersection of the first and second wall sections 127, 128. Another one of the corner portions 160 comprises a portion of the third wall section 129, a portion of the fourth wall section 130, and the corner 162 that is formed by the intersection of the third and fourth wall sections 129, 130. Each of the side portions 161 includes the remainder of the wall sections 127-130 (i.e., the portions that are not part of the corner portions 160) and extends between two of the corner portions 160. In the exemplified embodiment, the locking feature 150 is located only on the side portions 161 and not on the corner portions 160. Thus, the corner portions 160 of the outer annular wall 120 are free of the locking feature 150. This enhances the ability to insert the stack 200, and most specifically the window panel 201, into the display cavity 123 without breaking or shattering the window panel 201, which in some embodiments may be formed from glass.

Still referring to FIGS. 1-4, the frame 100 comprises a front surface 101 and a rear surface 102 opposite the front surface 101. In the exemplified embodiment, the front surface 101 is formed, at least in part, by the front edge 125 of the outer annular wall 120. Furthermore, in the exemplified embodiment the frame 100 comprises a plurality of hanger elements 165 that are formed integrally with the frame 100. In the exemplified embodiment, there are two of the hanger elements 165 on the frame. More specifically, the hanger elements 165 are formed into the rear surface 102 of the frame 100. In the exemplified embodiment, each of the hanger elements 165 is a sawtooth hanger. However, the invention is not to be so limited and the hanger elements 165 can take on any configuration that is commonly used for hanging items from a wall or other support surface. Thus, the hanger elements 165 can take on any configuration that is typically used for receiving a fastener such as a nail or screw that is protruding from a wall for hanging the frame assembly 1000 from the wall.

The hanger elements 165 are formed integrally with the frame 100. Thus, the hanger elements 165 are not separate components from the frame 100. Rather, in the exemplified embodiments the hanger elements 165 are formed by creating specially shaped apertures through the frame 100 to permit the hanging of the frame assembly 1000 from a wall or other vertical support surface. In the exemplified embodiment, the apertures extend through the rear surface 102 of the frame 100 and through the floor 111 of the floor structure 110 of the frame 100. In the exemplified embodiment, the hanger elements 165 are located on two adjacent sides of the frame 100 (e.g., the first wall section 127 and the second wall section 128). Thus, one of the hanger elements 165 enables the frame assembly 1000 to be hung in a portrait orientation while the other of the hanger elements 165 enables the frame assembly 1000 to be hung in a landscape orientation.

Figure 5:
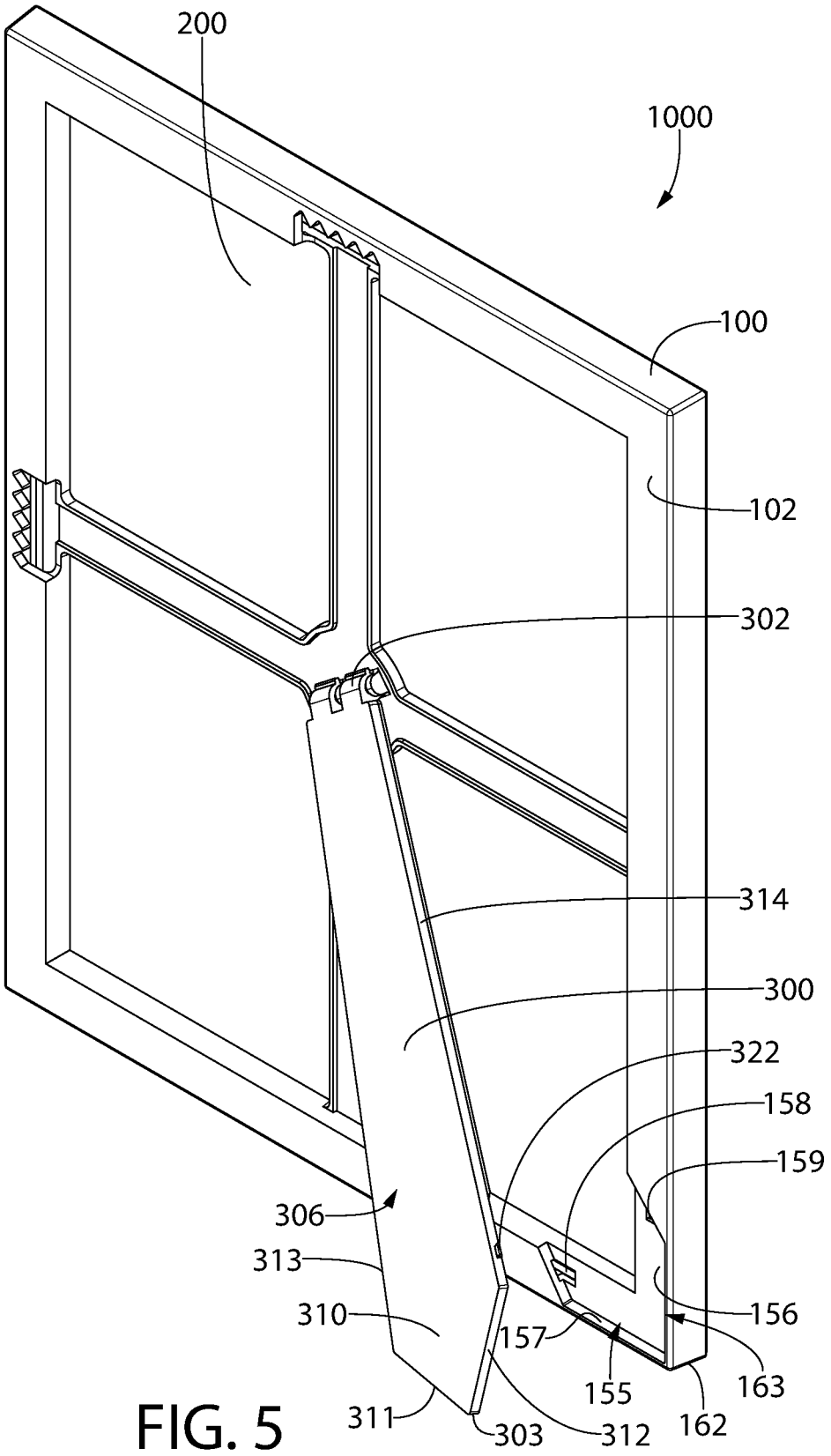
FIG. 5 is a front view of a frame of the frame assembly of FIG. 1.

Referring briefly to FIGS. 1 and 5, the functionality of the easel 300 will be described. The easel 300 is pivotably coupled to the frame 100 as described above. More specifically, the easel 300 is pivotable between: (1) a storage position, illustrated in FIG. 1, in which the easel 300 is stored away for later use and will not interfere with hanging the frame assembly 1000 from a wall; and (2) a use position, illustrated in FIG. 5, in which the easel 300 is available for supporting the frame assembly 1000 on a horizontal support surface such as a desk, a shelf, or the like. The details of this functionality will be better understood from the description below.

Referring to FIGS. 5-7A, the functionality of the easel 300 will be described in conjunction with a description of the structure of the frame 100 that facilitates the function. In the exemplified embodiment, the rear surface 102 of the frame 100 comprises a recessed portion 155. The recessed portion 155 comprises a floor 156 and a sidewall 157 extending from the floor 156 to the rear surface 155 of the frame 100. In the exemplified embodiment, the sidewall 157 is formed by the outer annular wall 120. The recessed portion 155 comprises a first opening 158 and a second opening 159 that extend through the floor 156 of the recessed portion 155. The first and second openings 158, 159 work in conjunction with protrusions on the easel 300 to facilitate locking the easel 300 to the frame 100 in the storage position, as discussed further below.

The easel 300 comprises a distal portion 310 that includes the distal end 303. The distal portion 310 comprises a first distal edge 311 and a second distal edge 312 that intersect at the distal end 303. The first and second distal edges 311, 312 intersect at a perpendicular angle in the exemplified embodiment, although the invention is not to be limited to this in all embodiments. The distal portion 310 of the easel 300 also comprises a first sidewall edge 313 extending from the first distal edge 311 towards the proximal end 302 of the easel 300 and a second sidewall edge 314 extending from the second distal edge 312 towards the proximal end 302 of the easel 300.

The easel 300 comprises a locking element 320 for locking the easel 300 in the storage position. Specifically, the locking element 320 comprises a first locking tab 321 protruding beyond the first sidewall edge 313 of the easel 300 along the distal portion 310 of the easel 300 and a second locking tab 322 protruding beyond the second sidewall edge 314 of the easel 300 along the distal portion 310 of the easel 300. The first locking tab 321 may extend directly from the first sidewall edge 313, or it may extend from the front or rear surfaces 306, 307 of the easel 300. Similarly, the second locking tab 322 may extend directly from the second sidewall edge 314, or it may extend from the front or rear surfaces 306, 307 of the easel 300.

Figure 6:
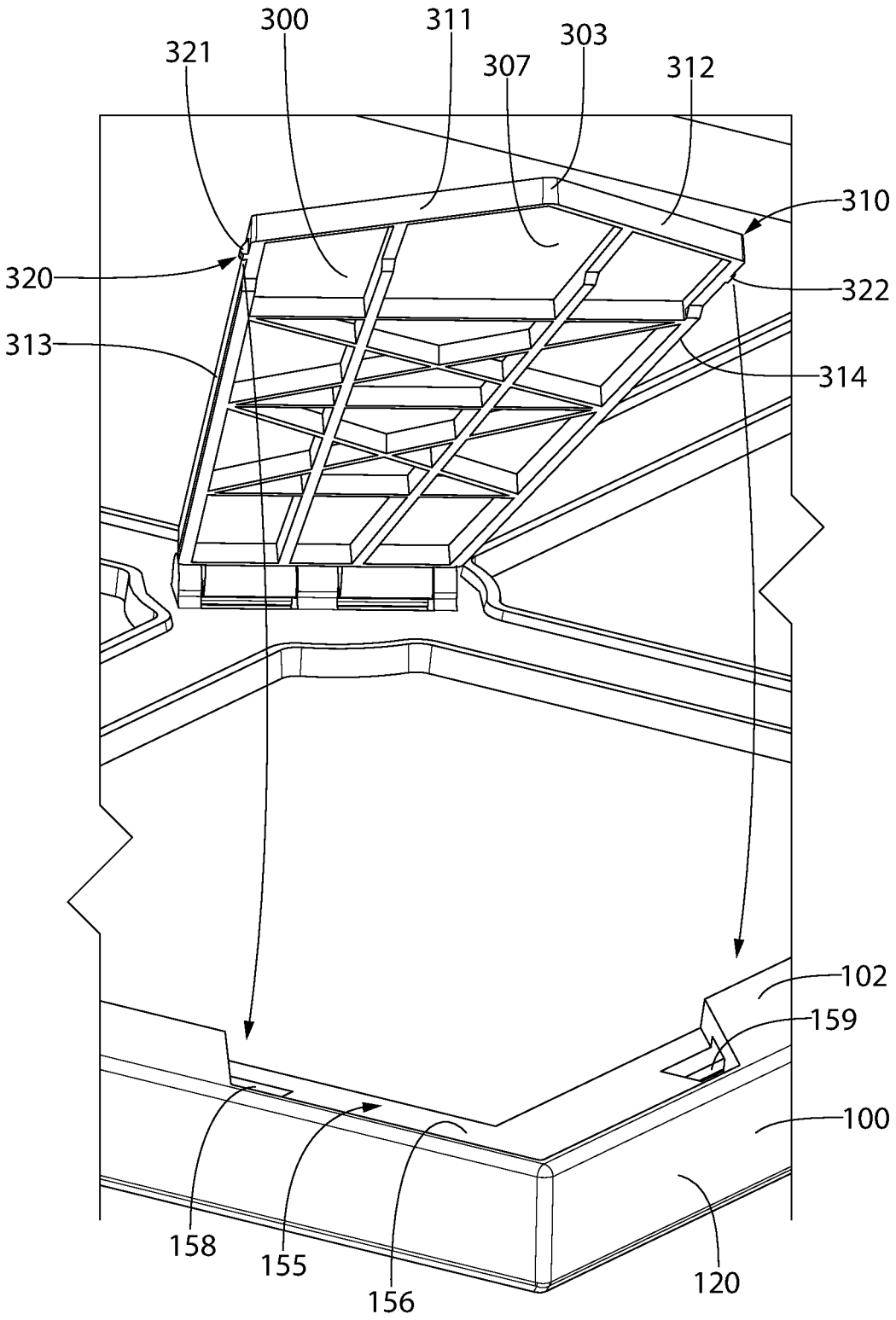
FIG. 6 is a close-up view illustrating the process for altering the easel from the use position to the storage positions.
Figure 7A:
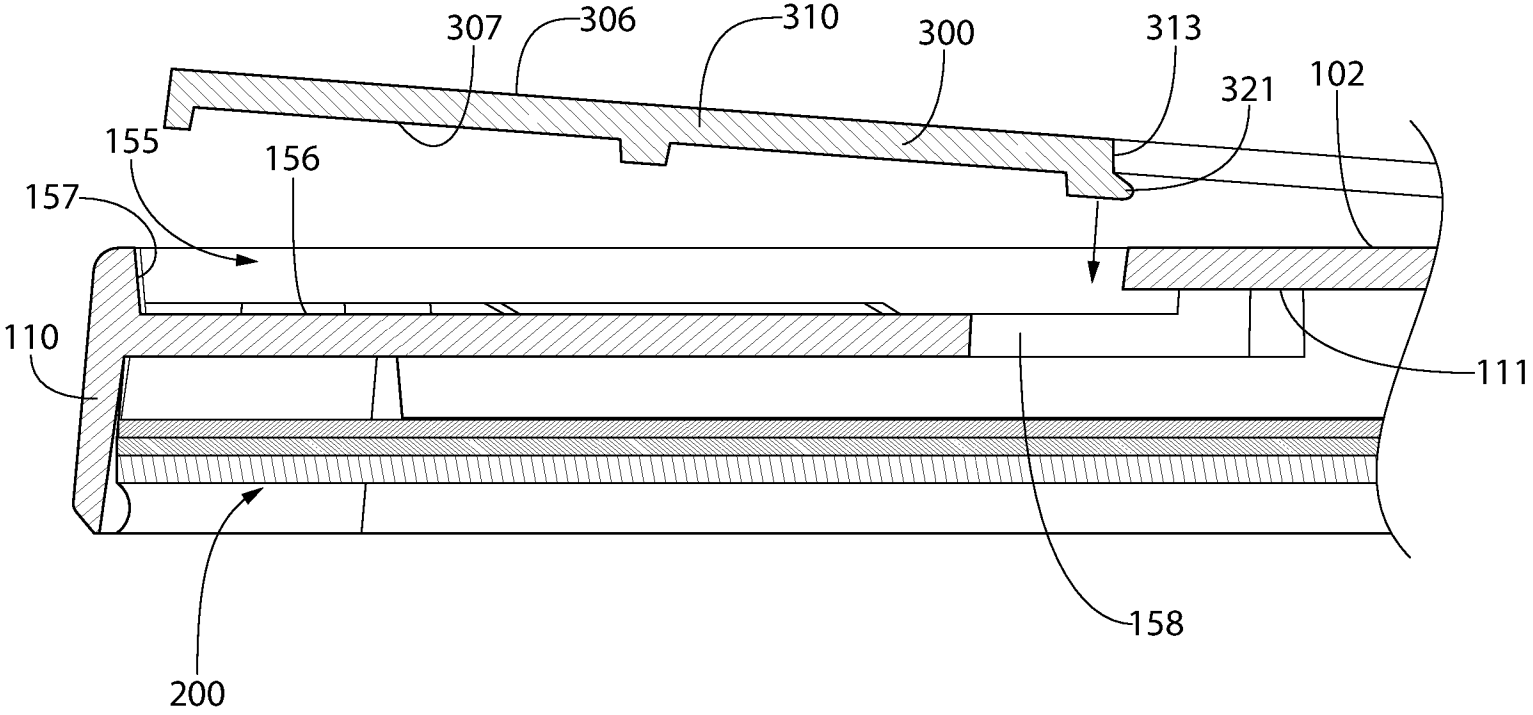
FIGS. 7A and 7B are cross-sectional views taken along line VII-VII of FIG. 3 illustrating the process for altering the easel from the use position to the storage position, wherein the stack is positioned within the display cavity of the frame.
Figure 7B:
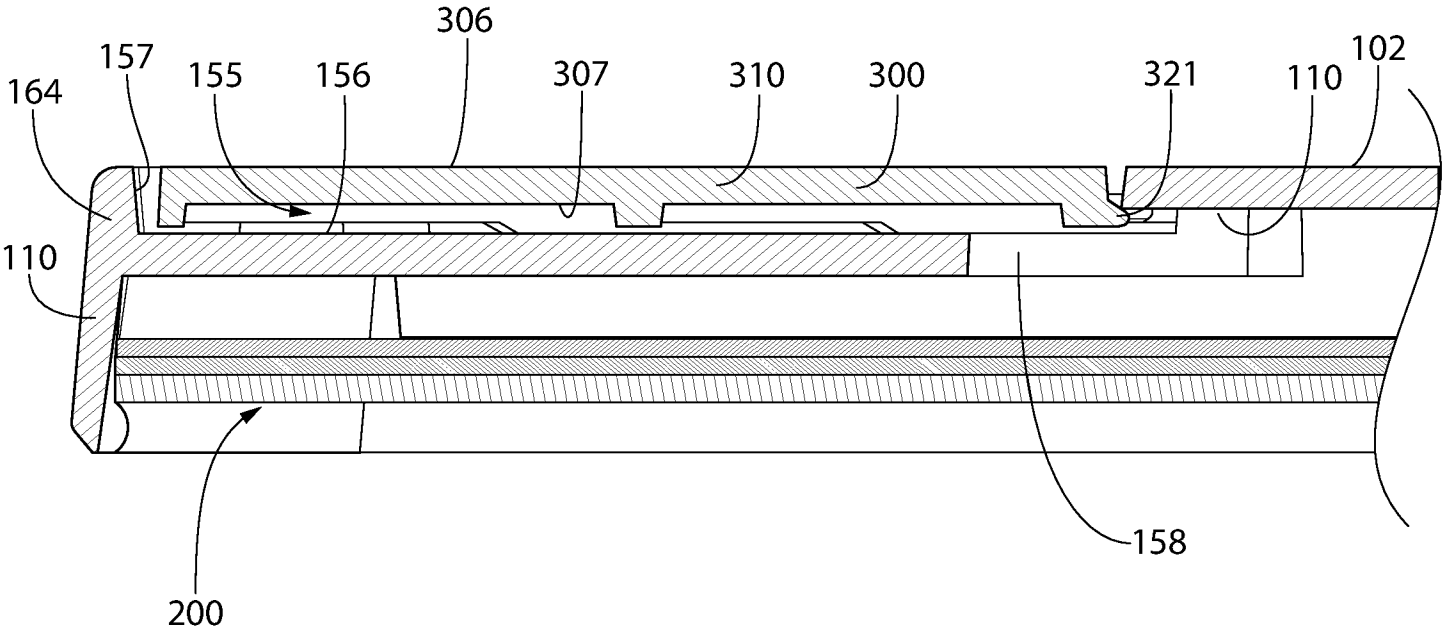

Referring to FIGS. 6-7B, the process of altering the easel 300 from the use position to the storage position will be described. In the use position, the distal portion 310 of the easel 300 is spaced apart from the frame 100 and no portion of the easel 300 is located within the recessed portion 155 of the rear surface 102 of the frame 100. As a result, the first and second distal edges 311, 312 can contact a support surface (i.e., shelf or the like) to support the frame 100 in a portrait or landscape orientation. When the easel 300 is not being used, it may be preferable to tuck the easel 300 away in the recessed portion 155 of the rear surface 102 of the frame 100. To do this, the rear surface 307 of the easel 300 is moved towards the rear surface 102 of the frame 100 as shown with the arrows in FIG. 6. As the easel 300 is moved towards the rear surface 102 of the frame 100, the distal portion 310 of the easel 300 enters into the recessed portion 155 of the rear surface 102 of the frame 100. Thus, in the storage position, the distal portion 310 of the easel 300 nests within the recessed portion 155 of the rear surface 102 of the frame 100.

As the distal portion 310 of the easel 300 enters into the recessed portion 155 of the rear surface 102 of the frame 100, the first and second locking tabs 321, 322 pass through the first and second openings 158, 159 of the recessed portion 155, respectively, until the first and second locking tabs 321, 322 engage the floor 111 of the floor structure 110 of the frame 100. Due to the engagement between the locking tabs 321, 322 of the easel 300 and the floor 111 of the floor structure 100, the easel 300 becomes locked in place in the storage position. This engagement between the locking tabs 321, 322 of the easel 300 and the floor 111 of the floor structure 100 is best illustrated in FIGS. 3 and 7B. In some embodiments, the engagement between the locking tabs 321, 322 of the easel 300 and the floor 111 of the floor structure 110 is sufficiently strong such that the entire frame 100 and/or frame assembly 1000 can be lifted by the easel 300 alone while the easel 300 remains locked in the storage position.

The locking tabs 321, 322 engaging the floor 111 of the floor structure 110 is merely one embodiment that may be used for securing or locking the easel 300 in the storage position. In other embodiments, the easel 300 may be locked into the storage position due to frictional contact between the sidewall 157 of the recessed portion 155 and the peripheral edge of the easel 300. In such embodiments, as the easel 300 is pivoted so that the distal portion 310 of the easel 300 nests within the recessed portion 155, the peripheral edge of the easel 300 will rub against the sidewall 157 of the recessed portion 155. The frictional contact between the sidewall 157 of the recessed portion 155 and the peripheral edge of the easel 300 will hold the easel 300 in place in the storage position until a user desires to forcefully pivot the easel 300 from the storage position to the use position. In other embodiments, a separate locking member may be movably attached to the frame 100 so that when the easel 300 is in the storage position, the locking member can be moved so as to block the easel 300 from moving out of the storage position. Such a locking member could be something similar to a turn button used for retaining a stack within a rabbet in a conventional frame. Other techniques could similarly be used to lock the easel 300 in the storage position.

It should be appreciated that the term "lock" as it relates to the securing of the easel 300 in the storage position does not mean that the easel 300 is permanently locked into the storage position. Rather, the term lock as used in that regard merely means that the easel 300 is held in the storage position with a force that is stronger than the force of gravity so that simply holding the frame upside-down will not cause the easel 300 to be removed from the recessed portion 155 of the rear surface 102 of the frame 100. Rather, a user will be required to impart some force onto the easel 300 relative to the frame 100 to move the easel 300 from the storage position to the use position, although the degree of this force is not limiting of the present invention.

As best seen in FIG. 7B, with the easel 300 in the storage position the front surface 306 of the easel 300 is flush with the rear surface 102 of the frame 100. In other embodiments, the front surface 306 of the easel 300 may be recessed relative to the rear surface 102 of the frame 100 when the easel 300 is in the storage position. Either way, the easel 300 should not protrude beyond the rear surface 102 of the frame 100 when the easel 300 is in the storage position. The reason for this is that if the frame assembly 1000 is hung on a wall, the easel 300 would contact the wall and interfere with the level hanging of the frame assembly 1000 if the easel 300 were to stick out past the rear surface 102 of the frame 100. Thus, in the exemplified embodiment the easel 300 can be stored away in the storage position in such a way that it will not interfere at all when the frame assembly 1000 is hung from a vertical support surface such as a wall using the hanger elements 165 or the like.

In the exemplified embodiment, the recessed portion 155 of the rear surface 102 of the frame 100 is located along a corner region 163 of the frame 100. The corner regions 163 of the frame 100 are the regions of the frame 100 that include one of the corners 162 of the frame 100. A portion 164 of the outer annular wall 120 extends from the floor 156 of the recessed portion 155 to a rear edge of the outer annular wall 120. The portion 164 of the outer annular wall 120 at least partially surrounds a peripheral edge of the distal portion 310 of the easel 300 when the easel 300 is in the storage position. More specifically, the portion 164 of the outer annular wall 120 surrounds and is adjacent to the first and second distal edges 311, 312 of the easel 300.

Figure 8:
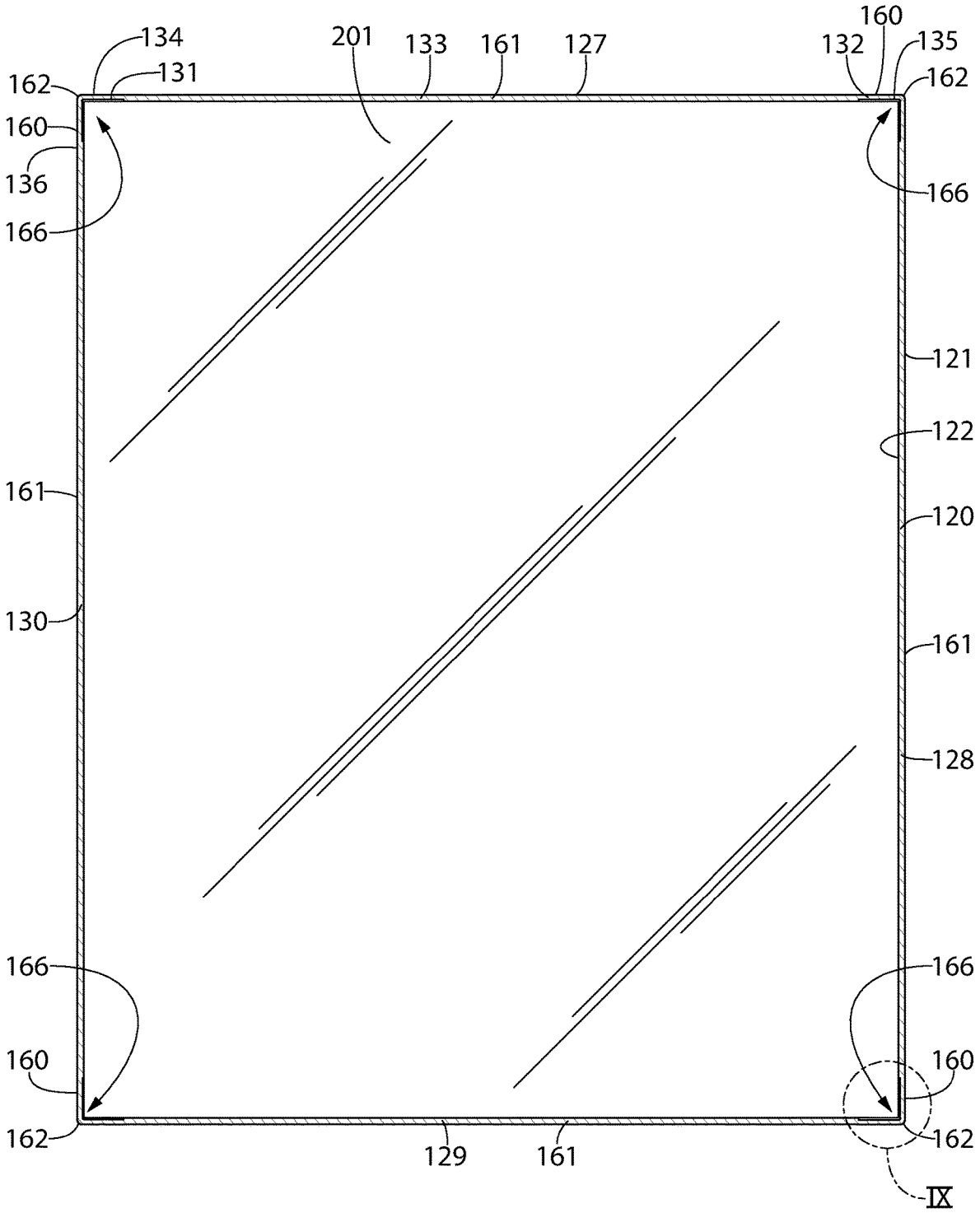
FIG. 8 is a cross-sectional view taken along line VIII-VIII of FIG. 1.
Figure 9:
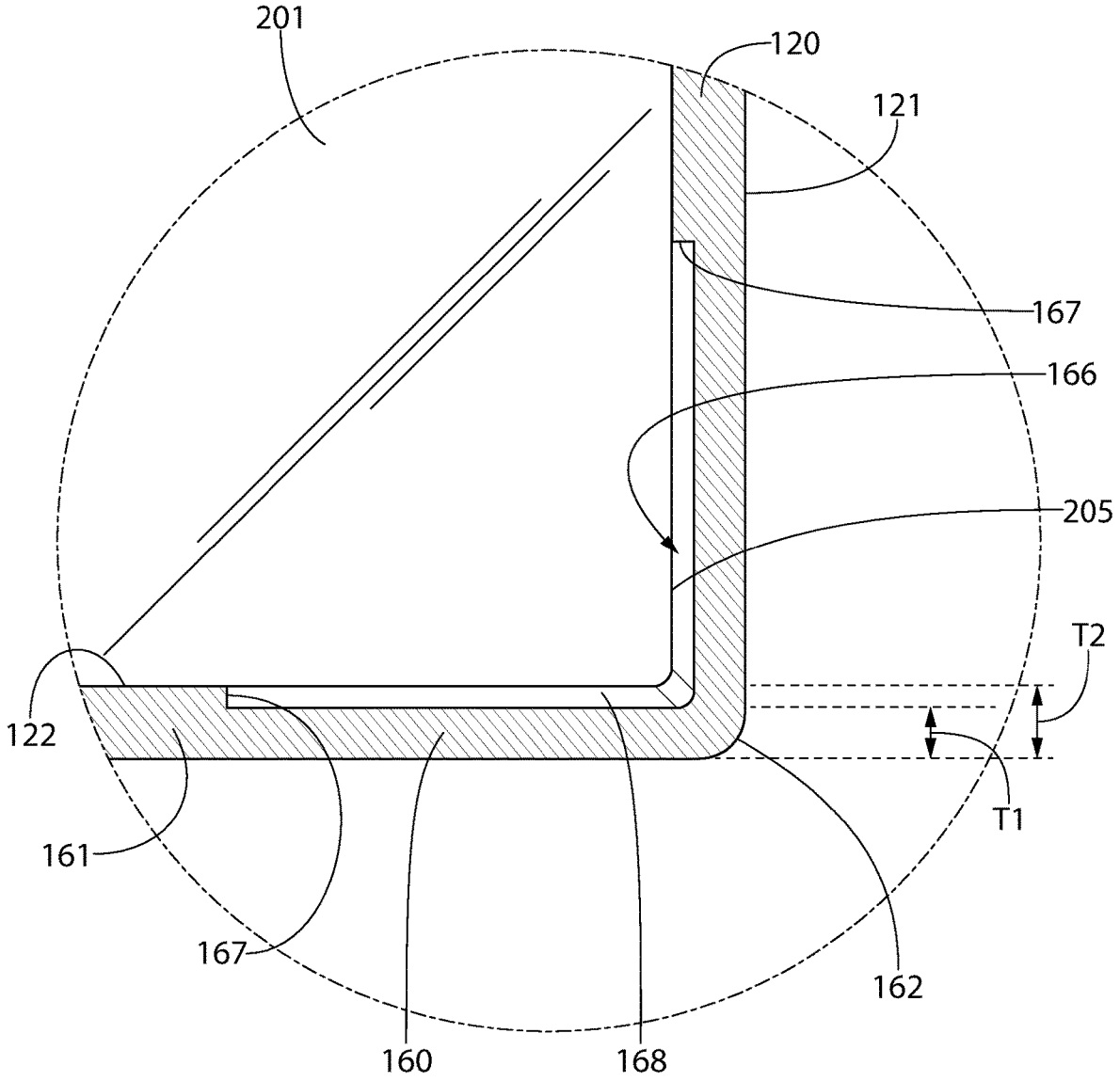
FIG. 9 is a close-up view of area IX of FIG. 8.

Referring to FIGS. 8 and 9, another feature of the frame 100 will be described. As noted previously, the outer annular wall 120 of the frame 100 comprises a plurality of corner portions 160 and a plurality of side portions 161. Each of the corner portions 160 comprises one of the corners 162 of the outer annular wall 120 and each of the side portions 161 extends between two of the corner portions 160. Furthermore, the outer annular wall 120 comprises an outer surface 121 and an inner surface 122. In the exemplified embodiment, the outer annular wall 120 has a first thickness T1 measured between the inner and outer walls 121, 122 along each of the corner portions 160. Furthermore, the outer annular wall 120 has a second thickness T2 measured between the inner and outer walls 121 along each of the side portions 161. The second thickness T2 is greater than the first thickness T1. Thus, the side portions 161 of the outer annular wall 120 are thicker than the corner portions 160 of the outer annular wall 120. The importance of this will be described in greater detail below. In certain embodiments, the first and second thicknesses T1, T2 are measured at the same height/elevation along the outer annular wall 120 between the floor 111 of the floor structure 110 and the front edge 125 of the outer annular wall 120.

Stated another way, as noted above the outer annular wall 120 comprises a plurality of wall sections including the first wall section 127, the second wall section 128, the third wall section 129, and the fourth wall section 130. In the exemplified embodiment, each of the wall sections 127-130 is a linear segment or section of the outer annular wall 120. Each of the wall sections 127-130 has the features described below, although they will only be described specifically with regard to the first wall section 127 in the interest of brevity. The first wall section 127 extends from a first end 134 to a second end 135 along a linear axis. The first wall section 127 comprises a first portion 131, a second portion 132, and a third portion 133 with the third portion 133 extending between the first and second portions 131, 132. The first portion 131 extends from the third portion 133 to the first end 134 of the first wall section 127 and the second portion 132 extends from the third portion 133 to the second end 135 of the first wall section 127.

The first and second portions 131, 132 of the first wall section 127 form parts of one of the corner portions 160 of the outer annular wall 120. Thus, the first and second portions 131, 132 of the first wall section 127 have the first thickness T1 measured between the inner and outer surfaces 121, 122 of the outer annular wall 120. The third portion 133 of the first wall section 127 forms a part of one of the side portions 161 of the outer annular wall 120. Thus, the third portion 133 of the first wall section 127 has a second thickness T2 measured between the inner and outer surfaces 121, 122 of the outer annular wall 120. Again, the second thickness T2 is greater than the first thickness T1.

The first portion 131 of the first wall section 127 forms a portion of one of the corner portions 160 of the outer annular wall 120 and the second portion 132 of the first wall section 127 forms a portion of a different one of the corner portions 160 of the outer annular wall 120. The same statement is true for each of the first through fourth wall sections 127-130. Moreover, the first portion 131 of the first wall section 127 and a second portion of a second one of the wall sections that is adjacent to the first wall section 127 collectively form one of the corner portions 160 of the outer annular wall 120. More specifically, the first portion 131 of the first wall section 127 and a second portion 136 of the fourth wall portion 130 collectively form the entirety of one of the corner portions 160 of the outer annular wall 120. Again, this same statement is true for each pair of adjacent wall sections 127-130.

As a result of the reduced thickness of the outer annular wall 120 along the corner portions 160 relative to the side portions 161, the inner surface 122 of the outer annular wall 120 comprises a plurality of recessed regions 166. Each of the recessed regions 166 of the inner surface 122 of the outer annular wall 120 comprises one of the corners 162 of the outer annular wall 120 (which also forms one of the corners of the frame 100). Thus, the recessed regions 166 form a pocket in the inner surface 122 of the outer annular wall 120 in the area along and directly adjacent to the corners 162.

In the exemplified embodiment, each of the recessed regions 166 extends the full height of the outer annular wall 120 from the floor 111 of the floor structure 110 to the front edge 125 of the outer annular wall 120. Stated another way, the outer annular wall 120 has a constant thickness (i.e., T1) measured between the inner and outer surfaces 121, 122 of the outer annular wall 120 along the entirety of each of the corner portions 160. The outer annular wall 120 may also has a constant thickness (i.e., T2) measured between the inner and outer surfaces 1221, 122 of the outer annular wall 120 along the entirety of each of the side portions 161 (not including the thickness of the locking tabs 151*a-d*).

In the exemplified embodiment, the outer surface 121 of the outer annular wall 120 is planar. Furthermore, as best seen in FIG. 9, the inner surface 122 of the outer annular wall 120 comprises a shoulder 167 located at each intersection between the corner portions 160 and the side portions 161. Thus, one of the shoulders 167 may be located at each end of the recessed portion 166 such that the recessed portion 160 is defined as the portion of the inner surface 122 of the outer annular wall 120 located between two of the shoulders 167 that are adjacent to the same corner 162. The shoulder 167 is the location at which the thickness of the outer annular wall 120 changes from the first thickness T1 to the second thickness T2.

In the exemplified embodiment, the shoulder 167 comprises a wall that extends perpendicular to the inner surface 122 of the outer annular wall 120. Thus, in the exemplified embodiment the thickness of the outer annular wall 120 changes abruptly from the first thickness T1 to the second thickness T2 at the location of the shoulder 167. Of course, the invention is not to be so limited in all embodiments and in other embodiments the shoulder 167 may comprise a ramp such that the thickness of the outer annular wall 120 ramps or tapers between the first and second thicknesses T1, T2 rather than changing abruptly as with the exemplified embodiment. In such an embodiment, the ramp may be oriented at an oblique angle relative to the inner surface 122 of the outer annular wall 120 along the corner and side portions 160, 161.

The recessed region 166 of the inner surface 122 of the outer annular wall 120 formed by the reduced thickness of the outer annular wall 120 along the corner portions 160 relative to the thickness of the outer annular wall 120 along the side portions 161 serves a distinct purpose in reducing the likelihood of the window panel 201 breaking during assembly or disassembly. Specifically, still referring to FIGS. 8 and 9, when the window panel 201 is located within the display cavity 123, a peripheral edge 205 of the window panel 201 is in contact with the inner surface 122 of the outer annular wall 120 along the side portions 161 but is spaced apart from the inner surface 122 of the outer annular wall 120 along the corner portions 160. Thus, a distinct gap 168 exists between the peripheral edge 205 of the window panel 201 and the inner surface 122 of the outer annular wall 120 along the corner portions 160 of the outer annular wall 120. When window panels like the window panel 201 break, it is typically because the corner of the window panel gets stuck against the frame. By maintaining a gap between the frame 100 and the window panel 201 along the corners of the window panel 201, such breakage of the window panel 201 can be reduced if not eliminated.

Figure 10:
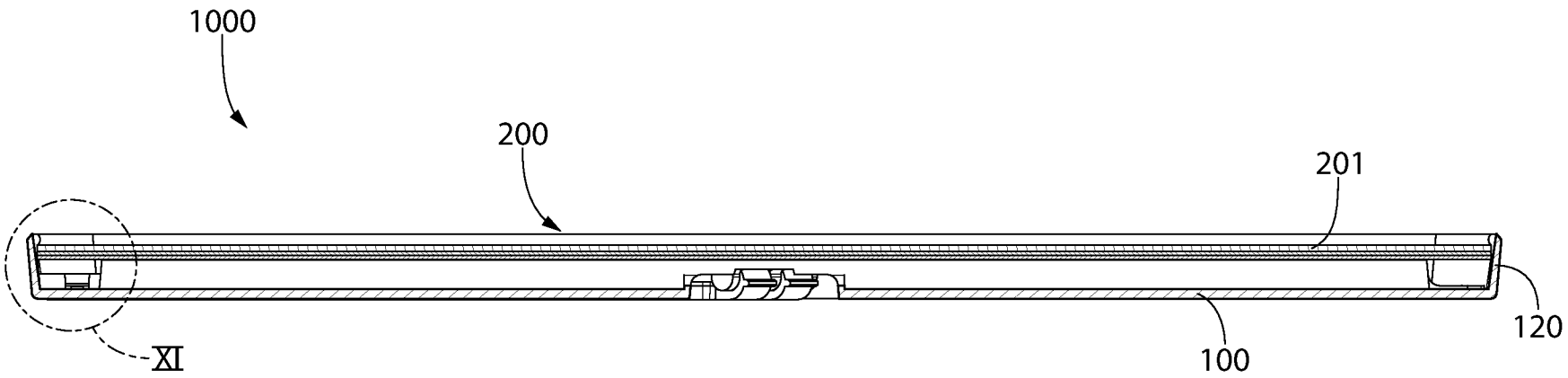
FIG. 10 is a cross-sectional view taken along line X-X of FIG. 3, wherein the stack is positioned within the display cavity of the frame.
Figure 11:
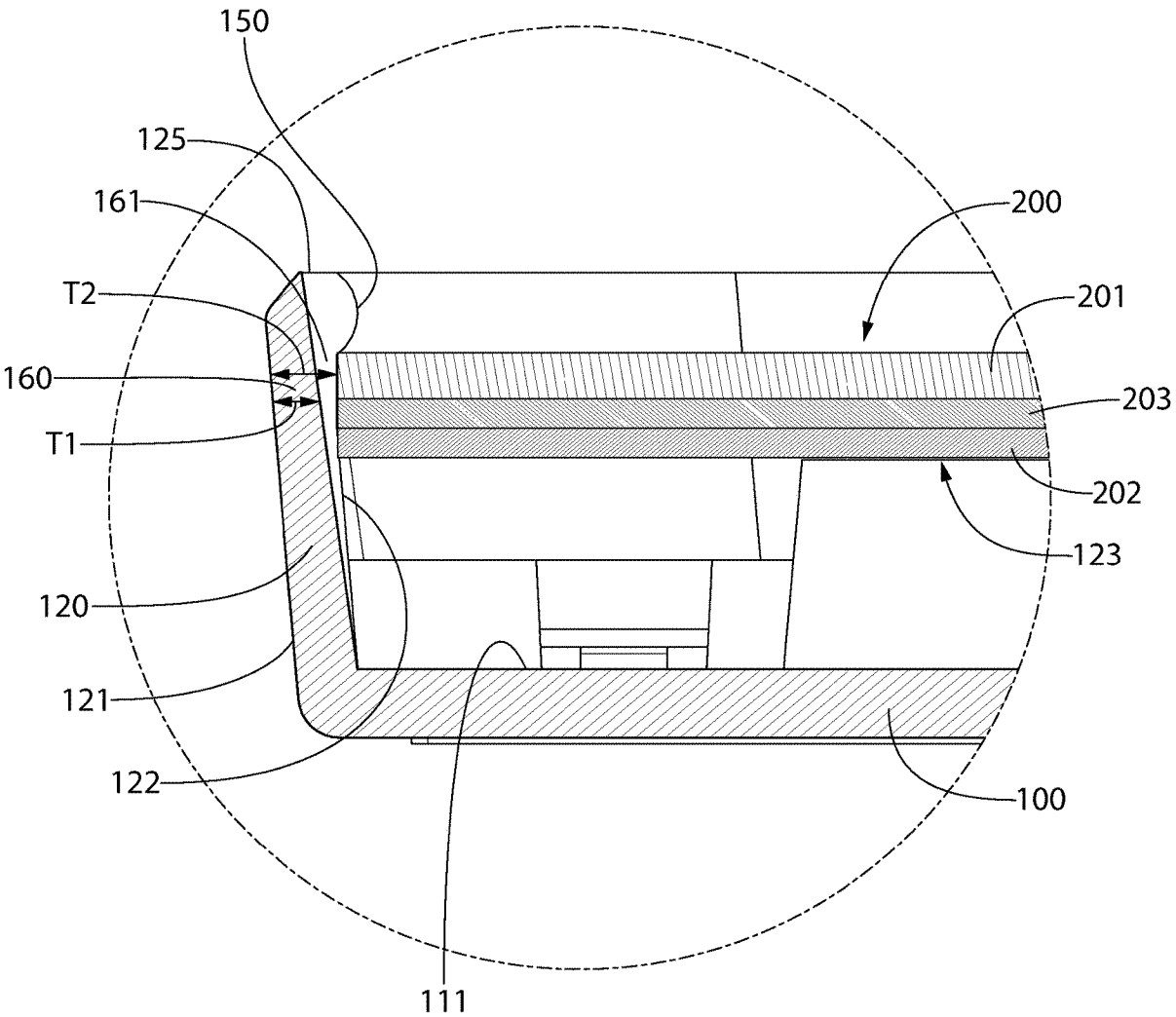
FIG. 11 is a close-up view of area XI-XI of FIG. 10.

Referring to FIGS. 10 and 11, this same concept of the reduced thickness of the outer annular wall 120 is illustrated. The corner portion 160 of the outer annular wall 120 is shown in cross-section with the side portion 161 being shown in the background and not in cross-section. As can be seen, at the elevation at which the window panel 201 contacts the outer annular wall 120, the outer annular wall 120 has a smaller thickness at the corner portion 160 than at the side portion 161. Thus, the peripheral edge 205 of the window panel 201 is in contact with the inner surface 122 of the outer annular wall 120 along the side portion 161 thereof, but not along the corner portion 160 thereof. The first and second thicknesses T1, T2 may be measured at a location along the outer annular wall 120 that is immediately adjacent (more specifically, immediately below) to the locking feature 150. Stated another way, the first and second thicknesses T1, T2 are measured at the same elevation or height along the outer annular wall 120 between the floor 111 of the floor structure 110 and the front edge 125 of the outer annular wall 120.

Thus, in the exemplified embodiment the peripheral edge 205 of the window panel 201 is spaced from the outer annular wall 120 around the corners 162 thereof due to a thinning of the outer annular wall 120 around the corners 162. However, this is not the only way to achieve this end and other structural arrangements may be used for the same purpose. For example, in one embodiment an angle at which the outer annular wall 120 extends from the floor 111 of the floor structure 110 may be different along the corner portions 160 than along the side portions 161. For example, the outer annular wall 120 may extend from the floor 111 at a first angle along the side portions 161 of the outer annular wall 120 and at a second angle along the corner portions 160 of the outer annular wall 120, with the first angle being greater (i.e., closer to 90°) than the second angle. This can be an extremely minor difference between the first and second angles. For example, the first angle may be between 89° and 90° and the second angle may be between 86° and 88°. Even this small difference between the first and second angles may be enough to ensure that the window panel 201 does not contact the outer annular wall 120 along the corner portions 160 thereof.

Figure 12:
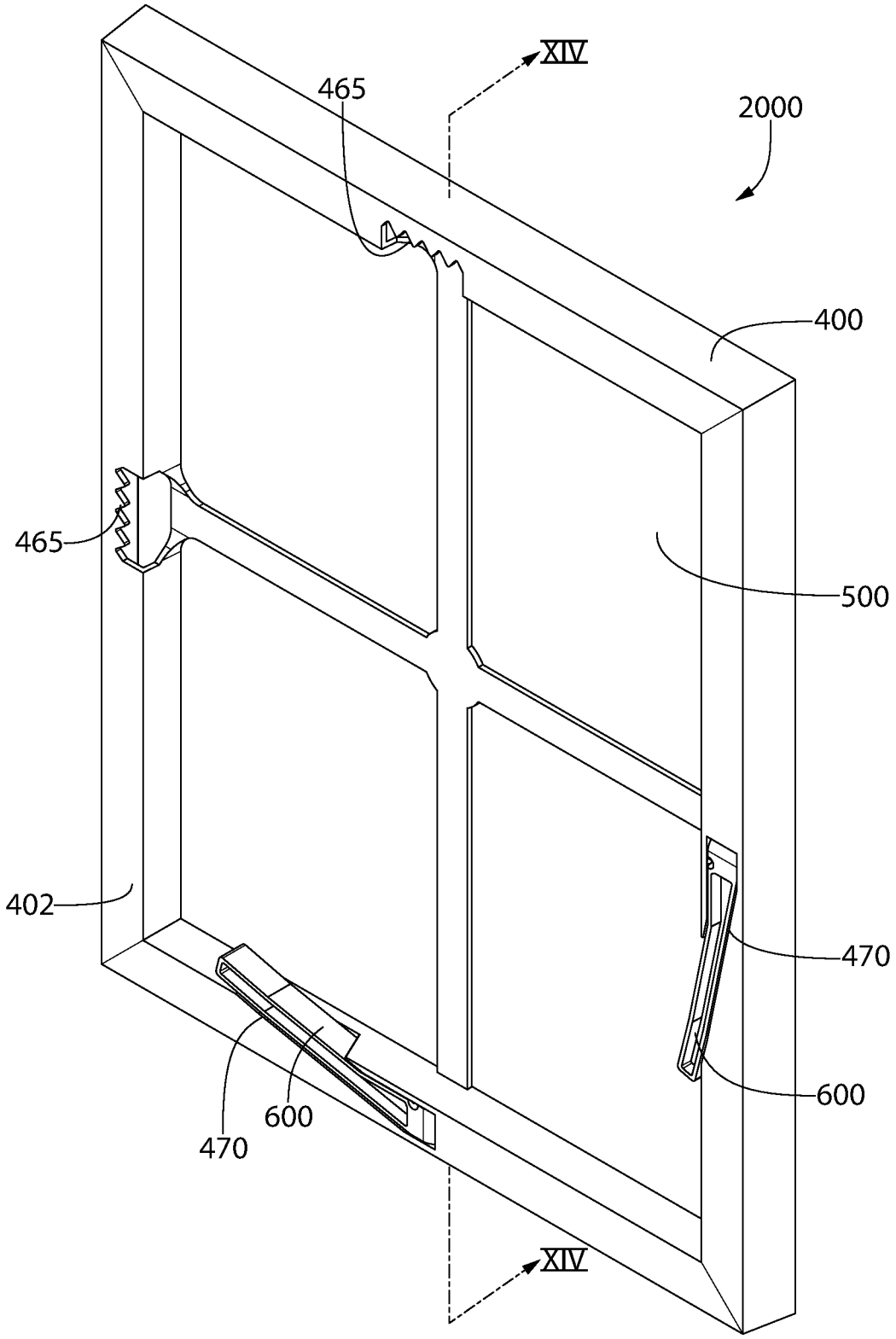
FIG. 12 is a rear perspective view of a frame assembly in accordance with a second embodiment of the present invention, wherein an easel of the frame assembly is in a storage position.
Figure 13:
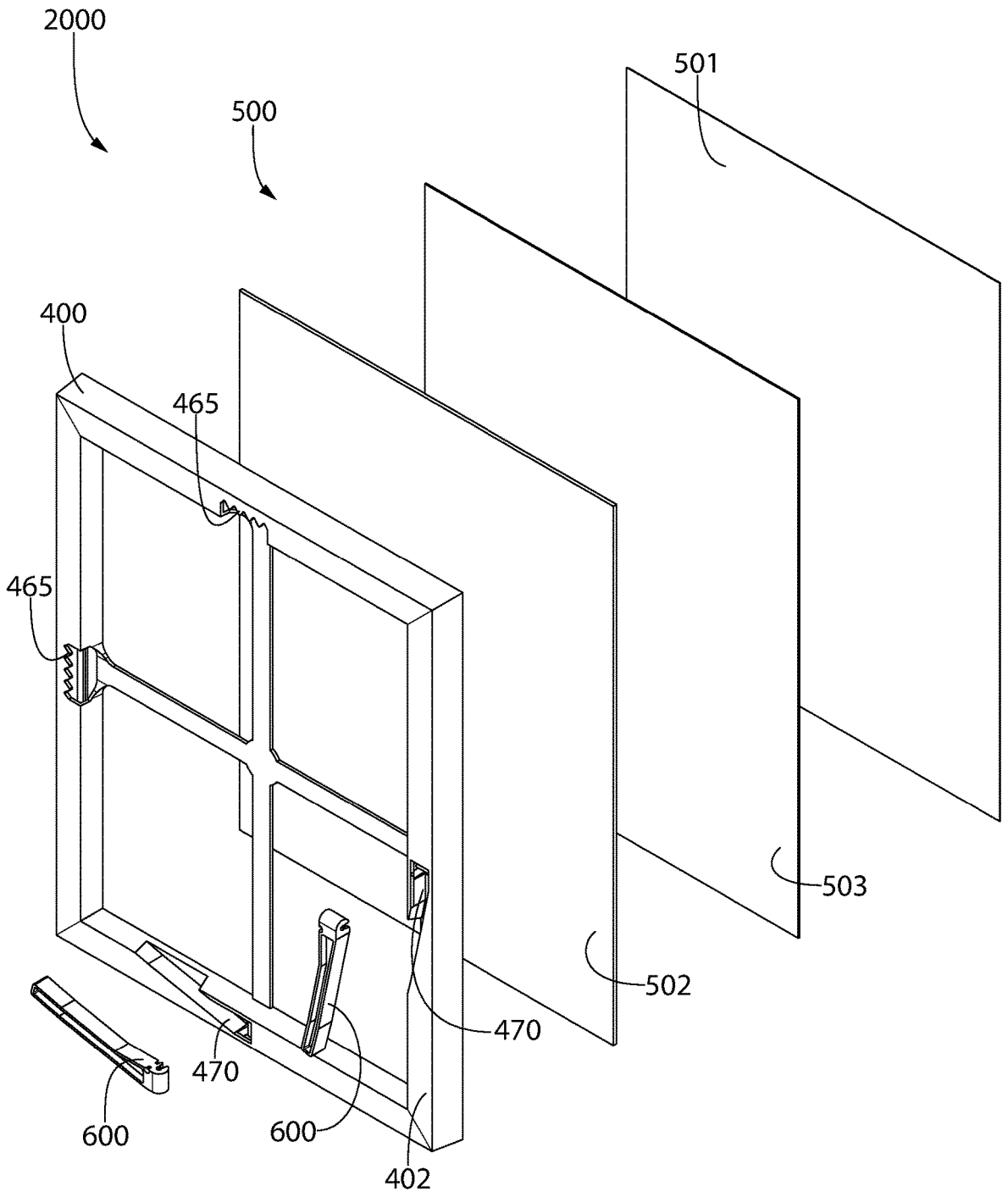
FIG. 13 is an exploded view of the frame assembly of FIG. 12.
Figure 14:
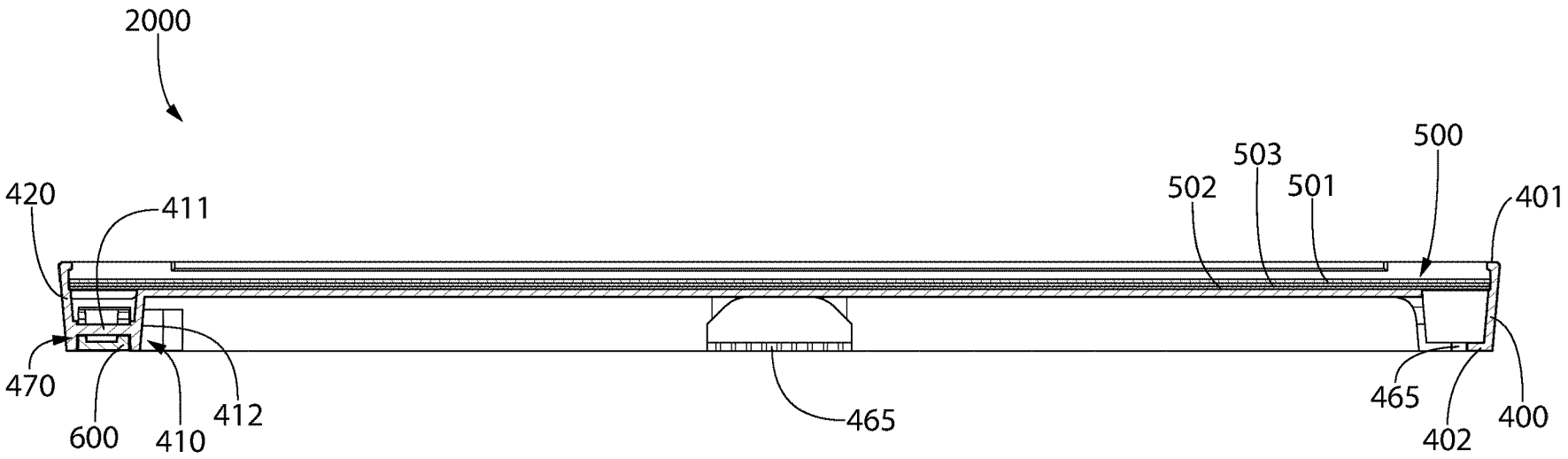
FIG. 14 is a cross-sectional view taken along line XIV-XIV of FIG. 12.

Referring to FIGS. 12-14, a frame assembly 2000 is illustrated in accordance with an embodiment of the present invention. Many of the features of the frame assembly 1000 described above are also present in the frame assembly 2000, and thus those features may not be described herein at all or in any great detail in the interest of brevity. That said, it should be appreciated that the description of the frame assembly 1000 is applicable to the frame assembly 2000 for features that are present in both. The discussion of the frame assembly 2000 will be mostly limited to features of the frame assembly 2000 that differ from the frame assembly 1000, other than a basic description of the frame assembly 2000 components.

The frame assembly 2000 generally comprises a frame 400 and a stack 500 that is retained in the frame 2100 for display, and an easel 600 that is pivotably coupled to the frame 400. In this embodiment, the frame 400 is extremely similar in structure to the frame 100 and the stack 500 may contain the same components as the stack 200. Thus, many of the details of the frame 400 and the stack 500 will not be provided below, but rather reliance on the description of the frame 100 and the stack 200 may be used, except for the differences provided below. The main difference in the frame 400 relative to the frame 100 is due to the easel 600 being different than the easel 300, which requires a different structure on the frame 400 to support the easel 600. The stack 500 may comprise a window panel 501, a backer panel 502, and a display article 503.

The frame 400 comprises a front surface 401 and a rear surface 402 opposite the front surface 401. Furthermore, the frame 400 comprises a floor structure 410 and an outer annular wall 420, much like the frame 100. The floor structure 410 comprises a floor 411 and an inner annular wall 412. On the rear of the frame 100 the rear surface 402 extends between the inner and outer annular walls 412, 420. The frame comprises hanger elements 465 that are identical to the hanger elements 165 described above and thus the hanger elements 465 will not be described further here.

The frame 400 comprises at least one groove 470 formed into the rear surface 402 thereof. The groove 470 is a sort of depression formed into the rear surface 402 of the frame 400 within which the easel 600 may be at least partially located. Thus, one of the easels 600 is pivotably (and detachably) coupled to the frame 100 within each of the grooves 470. In the exemplified embodiment, the frame 400 comprises two of the grooves 470 located along adjacent sides of the frame 400 so that the easels 600 can be used to support the frame 400 on a horizontal support surface in a portrait or landscape orientation. The easels 600 are pivotably coupled to the frame 100 between: (1) a storage position, illustrated in FIG. 12, in which the easel 600 at least partially nests within the groove 470 and no portion of the easel 600 protrudes beyond the rear surface 402 of the frame 400; and (2) a use position in which the easel 600 at least partially protrudes from the rear surface 402 of the frame 400 to support the frame 400 on a support surface.

To alter the easel 600 between the storage and use positions, the easel 600 pivots about a pivot axis P-P. In the exemplified embodiment, the pivot axis P-P of the easel 600 that is labeled in FIG. 16, for example, forms a longitudinal axis of the frame 400. The pivot axis of the easel 600 that is not labeled in FIG. 16 forms a transverse axis of the fram3. Thus, the pivot axis P-P, in some embodiments, will form either the transverse axis of the frame 400 or the longitudinal axis of the frame 400.

Figure 15:
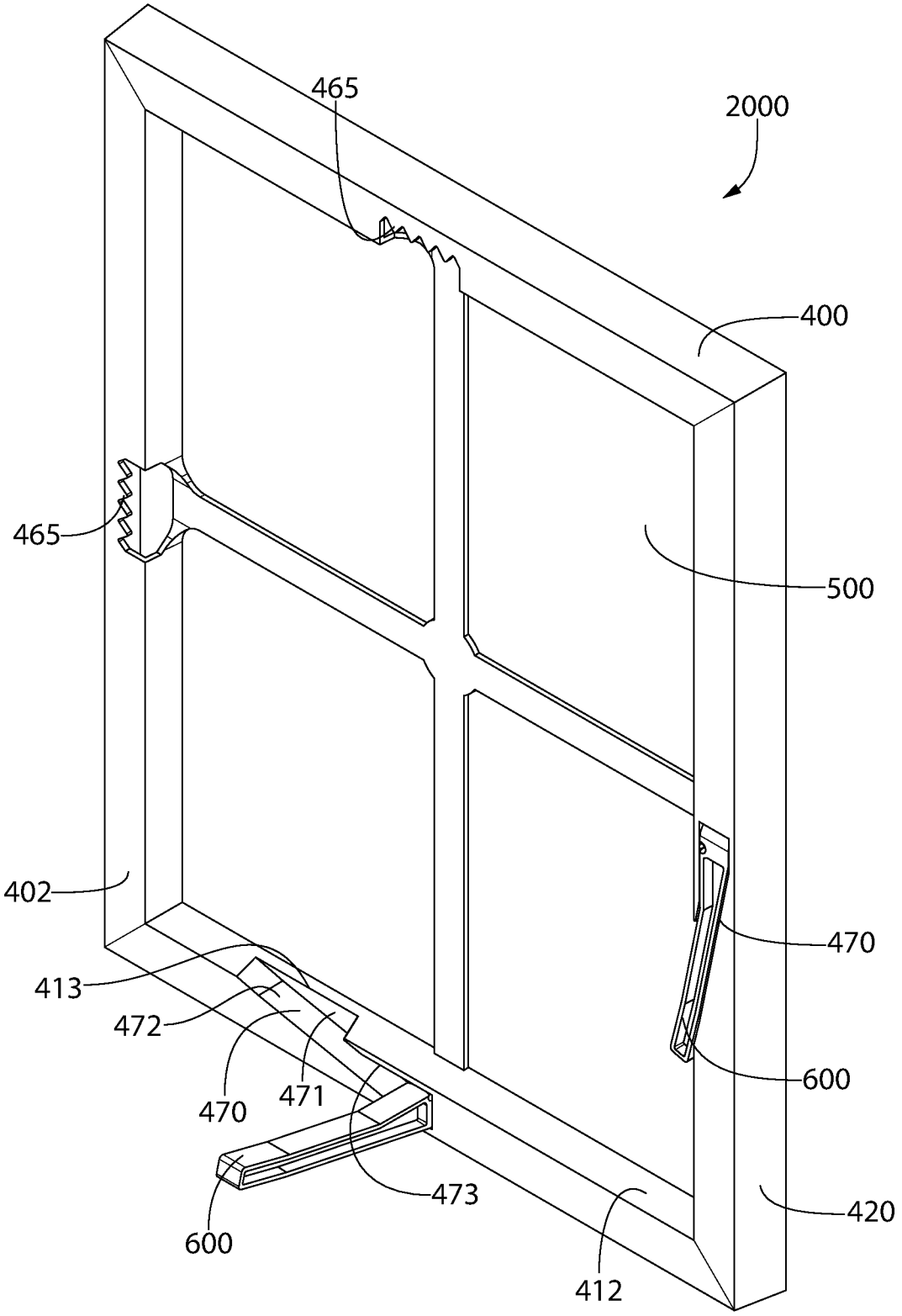
FIG. 15 is a rear perspective view of the frame assembly of FIG. 12 wherein the easel is in a use position.
Figure 16:
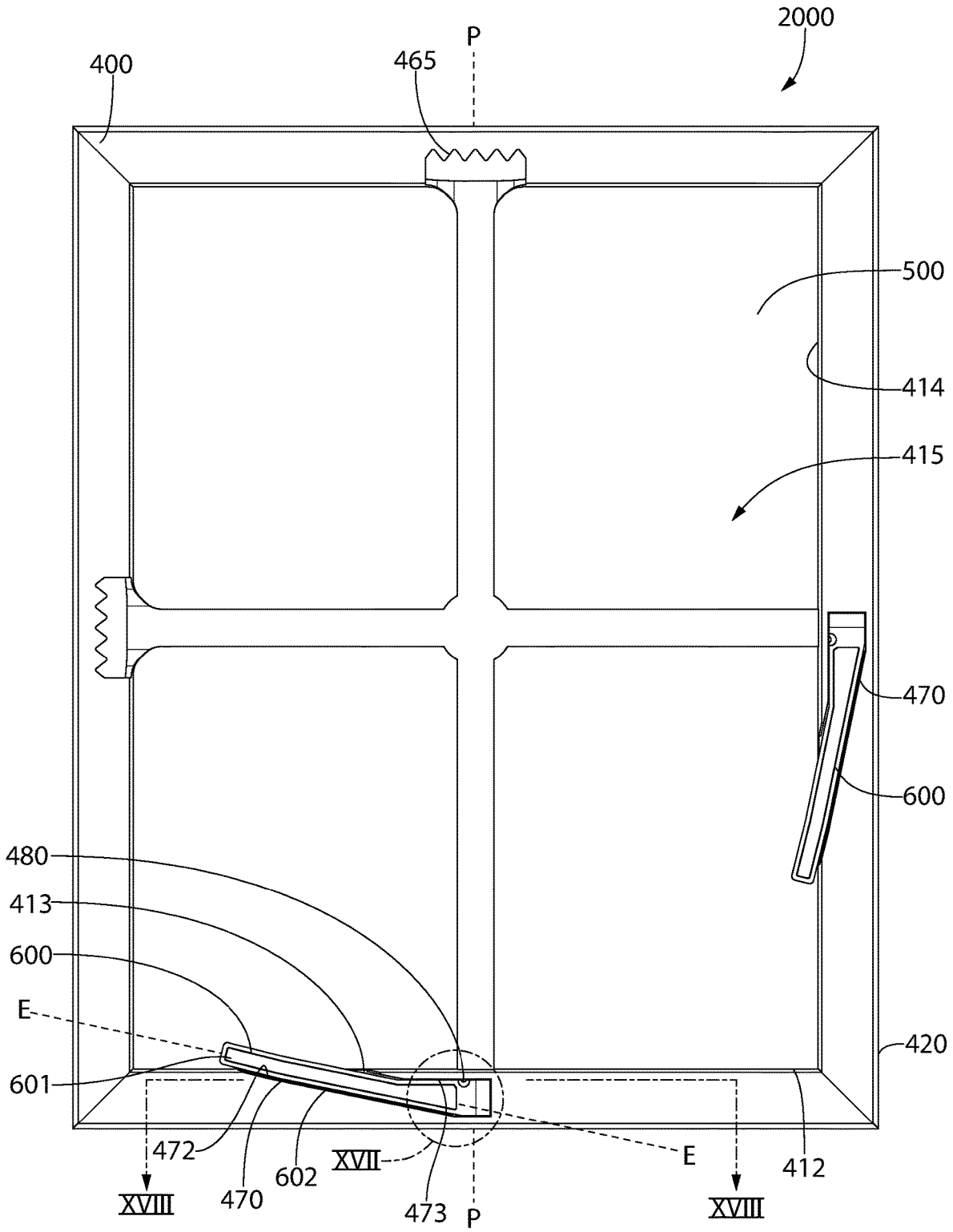
FIG. 16 is a rear view of the frame assembly of FIG. 12.
Figure 17:
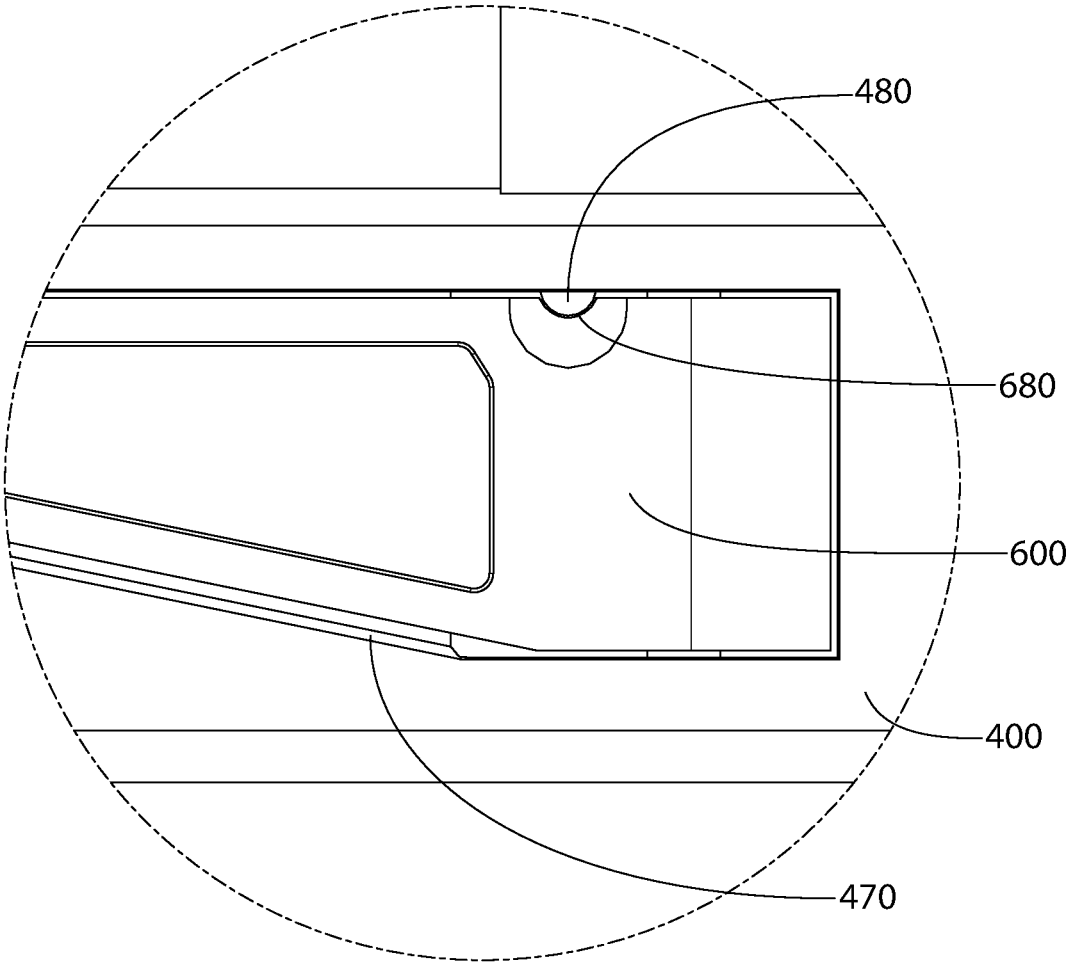
FIG. 17 is a close-up view of area XVII-XVII of FIG. 16.

Referring to FIGS. 15 and 16, the groove 470 and the easel 600 will be further described. The groove 470 is defined by a floor 471, a first sidewall 472 extending from the floor 471 to the rear surface 402 of the frame 400, and a second sidewall 473 extending from the floor 471 to the rear surface 402 of the frame 400. The second sidewall 473 of the groove 470 is formed by an inner surface of the inner annular wall 412. In the exemplified embodiment, the first sidewall 472 is oriented obliquely relative to the pivot axis P-P and the second sidewall 473 is oriented perpendicularly to the pivot axis P-P. There is an opening 413 formed into the inner annular wall 412 that forms a passageway into the groove 470. When the easel 600 is in the storage position, a portion of the easel 600 protrudes through the opening 413 to provide a portion of the easel 600 that is readily accessible for gripping by a user to alter the easel 600 from the storage position into the use position.

Of course, the invention is not to be limited by the drawings provided herewith in all embodiments. Specifically, in other embodiments the groove may be fully enclosed such that it has no opening in either of the sidewalls. In such an embodiment, the easel 600 may include a tab or other feature that will enable a user to grip the easel 600 to pivot it out of the storage position. In other embodiments, the groove may have a larger cross-sectional area at least in one location thereof compared to the easel 600. As such, a user will be able to put his/her finger into the groove between the sidewall of the groove and the easel 600 to move the easel 600 out of the storage position. For example, the easel may taper in width while the groove has a constant width so that near the distal end of the easel, a user may be able to put his/her finger into the groove to pull the easel out of the storage position and into the use position. Thus, other structural configurations are possible aside from that which is depicted in the drawings provided herewith that would enable a user to grip the easel 600 to alter it from the storage state to the use state.

Referring to FIGS. 15, 16, 18A, and 18B, when the easel 600 is in the storage position, no portion of the easel 600 protrudes beyond the rear surface 402 of the frame 400. Rather, the majority of the easel 600 nests within the groove 470 and a distal portion 601 of the easel 600 protrudes through the opening 413 in the inner annular wall 412 and into the empty space 415 defined or surrounded by an inner surface 414 of the inner annular wall 412. By protruding from through the opening 413 and into the empty space, the distal portion 601 of the easel 600 is readily available for gripping by a user to alter the easel 600 from the storage state into the use state. Specifically, a user can grip, even with just one finger, the distal portion 601 of the easel 600 and move the easel 600 away from the frame 400 to pivot the easel 600 into the use position. When the easel 600 is in the use state and being used to support the frame 100 on a horizontal support surface, the distal portion 601 of the easel 600 is in direct contact with the horizontal support surface.

In the exemplified embodiment, the easel 600 comprises an elongated arm such that the easel 600 extends (and is elongated) along an easel axis E-E. As shown in FIG. 16, the easel axis E-E is oblique to the pivot axis P-P of the easel 600. Thus, when the easel 600 is in the use position, a bottom surface 602 of the easel 600 extends obliquely from the rear surface 402 of the frame 400. This allows the frame 400 to be maintained at a desired tilt angle when supported in an upright position by the easel 600. The easel axis E-E is also oblique to each side of the outer annular wall 420 of the frame 400.

In the use position (FIGS. 15 and 18B), a first portion 605 of the easel 600 nests within the groove 470 and a second portion 606 of the easel 600 protrudes beyond the rear surface 402 of the frame 400 to support the frame 400 on a support surface. In the storage state, a first part of the second portion 606 of the easel 600 (i.e., the mounting portion) nest within the groove 470 and a second part (i.e., the distal portion 601) of the easel 600 protrudes from the inner surface 414 of the inner annular wall 412. As seen best in FIGS. 18A and 18B, the first portion 605 of the easel 600 is located within he groove 470 in both of the storage and use positions.

Figure 18A:
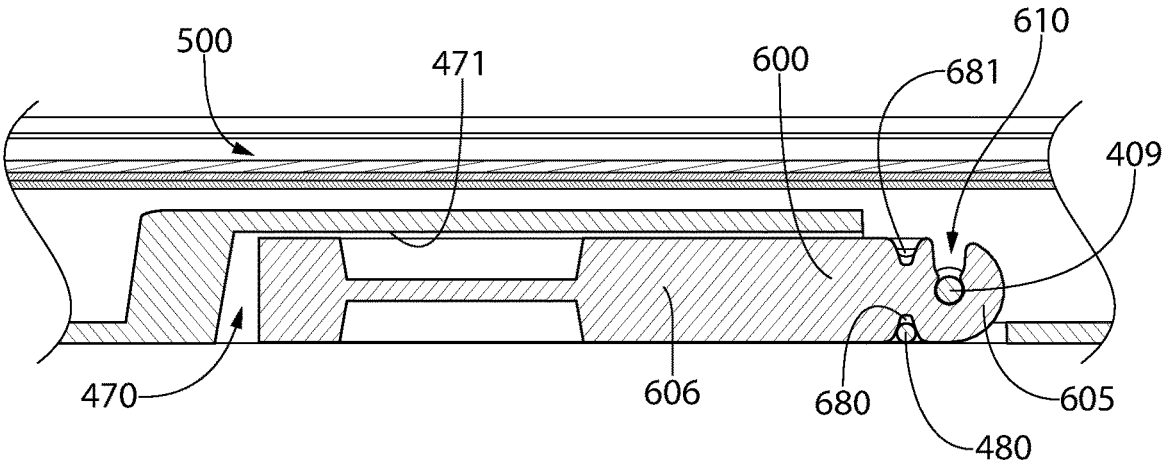
FIGS. 18A and 18B are cross-sectional views taken along line XVIII-XVIII of FIG. 15 illustrating the process for altering the easel between the storage and use positions.
Figure 18B:
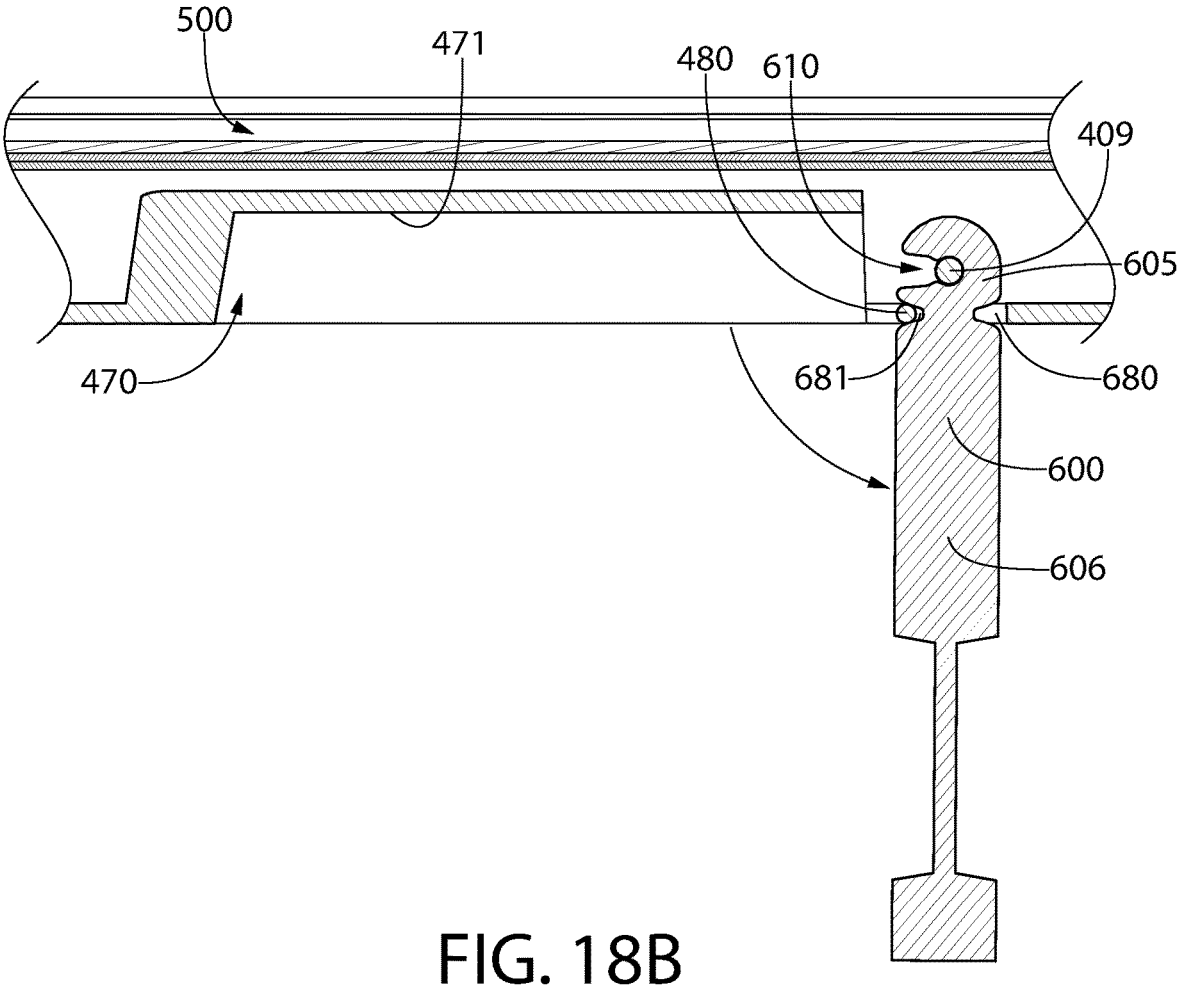
Figure 19:
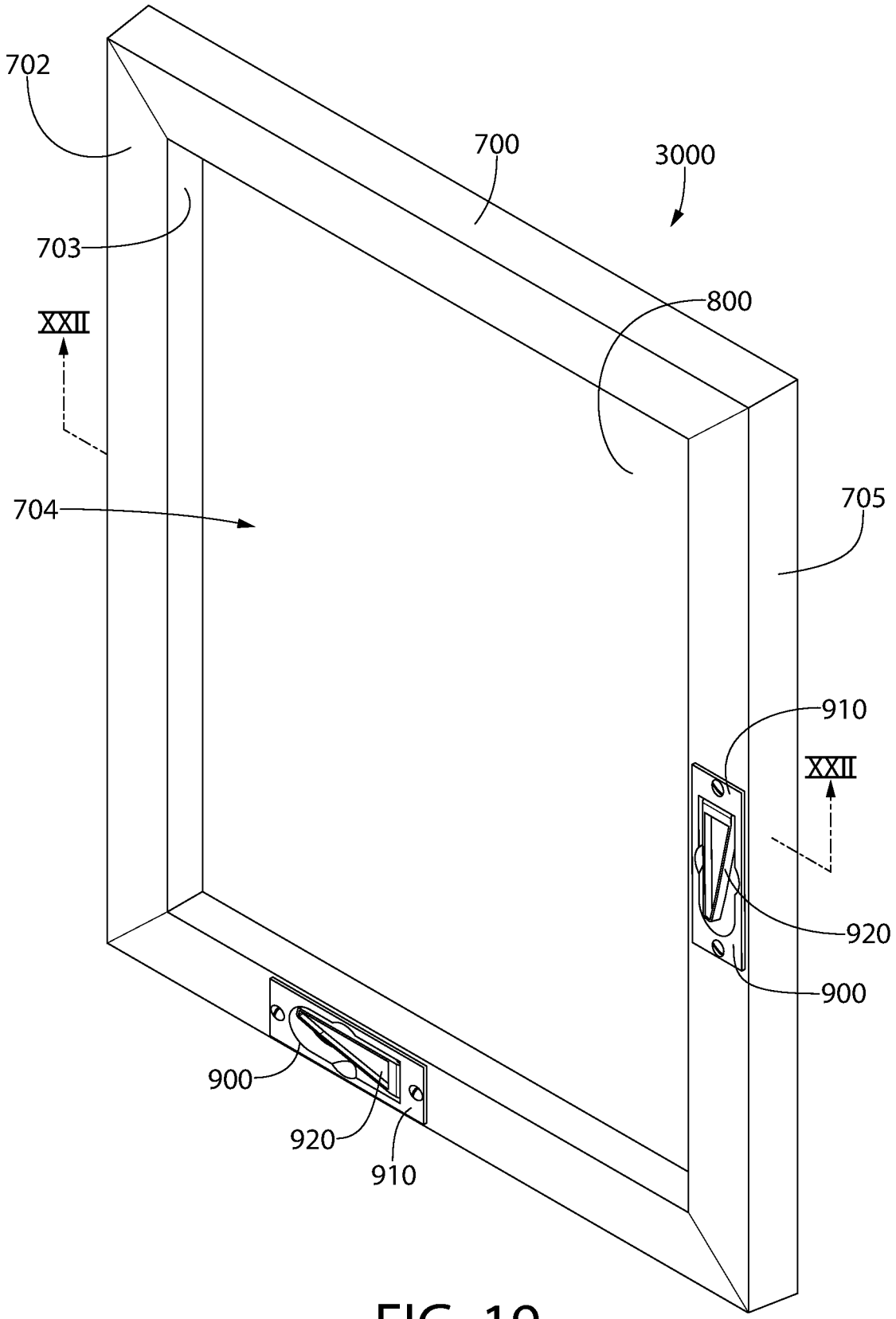
FIG. 19 is a rear perspective view of a frame assembly in accordance with a third embodiment of the present invention, wherein an easel of an easel assembly of the frame assembly is in a storage position.
Figure 20:
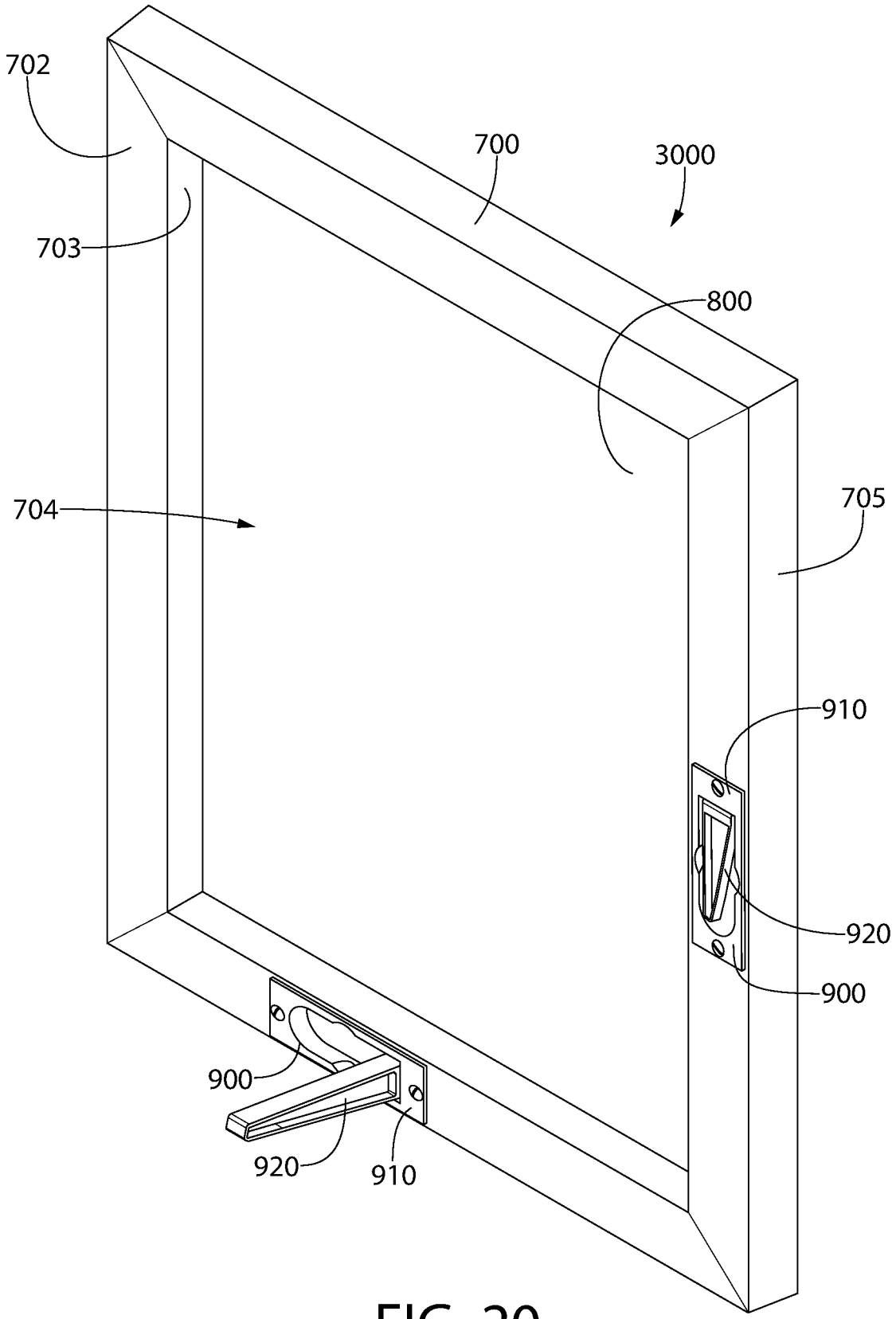
FIG. 20 is a rear perspective view of the frame assembly of FIG. 19 wherein the easel is in a user position.

The first portion 605 of the easel 600 comprises a first mounting element 610 that mates with a mounting element 409 of the frame 400 to pivotably and detachably couple the easel 600 to the frame 400. In the exemplified embodiment, the first mounting element 610 is a recess and the second mounting element 409 is a rod that is received within the recess. In other embodiments the second mounting element 409 may comprise a recess while the first mounting element 610 comprises a rod. Either way, the first and second mounting elements 409, 610 should be configured to mate or otherwise engage one another to maintain the coupling between the easel 600 and the frame 400 while permitting the easel 600 to repetitively transition between the storage and use positions. When in the storage position, an outer surface of the easel 600 is either flush with or recessed relative to the rear surface 402 of the frame 400, as best shown in FIG. 18A.

Referring to FIGS. 16-18B, the frame 400 further comprises a resistance element 480 for maintaining the easel 600 in the storage position or the use position until application of a force onto the easel 600 pivots the easel about the pivot axis P-P. Specifically, if the easel 600 is in the storage position, the easel 600 will remain in that position until active steps are taken by the user to transition the easel 600 out of the storage position. Similarly, if the easel 600 is in the use position, the easel 600 will remain in that position until active steps are taken by the user to transition the easel 600 out of the use position.

In the exemplified embodiment, the resistance element 480 comprises a protrusion extending from the second sidewall 473 of the groove 470 inwardly into the groove 470. The protrusion of the resistance element 480 frictionally contacts the easel 600 to maintain the easel 600 in any position relative to the frame 400 until a force is applied onto the easel 600 relative to the frame 400 to alter the position of the easel 600 relative to the frame 400. Moreover, in the exemplified embodiment the easel 600 comprises a first notch 680 and a second notch 681 on opposite sides of the easel 600. When the easel 600 is in the storage position, the protrusion 480 nests within the first notch 680 to lock the easel 600 in the storage position. When the easel 600 is in the use position, the protrusion 480 nests within the second notch 681 to lock the easel 600 in the use position.

Thus, the resistance element/protrusion 480 locks (in a temporary sense) the easel 600 in the storage and/or use positions. Furthermore, as the easel 600 transitions between the storage and use positions, the protrusion 480 frictionally contacts the outer surface of the easel 600 so that the easel 600 is not freely pivoting between the storage and use positions. Rather, the easel 600 only moves in response to a force being applied by the user that is greater than the frictional force between the resistance element/protrusion 480 and the outer surface of the easel 600. In some embodiments, this may be a very minor force. However, the frictional contact between the resistance element/protrusion 480 and the outer surface of the easel 600 allows the easel 600 to remain in any position between the storage position and the use position. Thus, if a user pivots the easel 600 from the storage position to a position that is halfway between the storage position and the use position, the easel 600 will remain in that position until an additional force is applied due to the frictional contact between the protrusion 480 and the outer surface of the easel 600.

The frame 400 has a plurality of sides, and in the exemplified embodiment is in the shape of a rectangle such that the frame 400 has two short sides and two long sides. In the exemplified embodiment, a ratio of a length of one of the short sides of the frame 400 to a length of the easel 600 is in a range of 2.5:1 to 3.5:1, more specifically 2.7:1 and 3.2:1, and still more specifically 2.8:1 and 3.0:1. Thus, as the dimensions of the frame(s) get larger, so too may the length of the easel(s) 900 that are coupled to that frame. This helps to ensure that the easel 600 will be capable of adequately supporting the frame 400 on a horizontal support surface at an appropriate and desirable tilt angle.

In the exemplified embodiment, the easel(s) 600 pivot a total of approximately 90° between the storage position and the use position. As noted previously, when the easel 600 is in the use state, the easel 600 does not extend perpendicularly from the rear surface 402 of the frame 400 in the exemplified embodiment. Rather, the easel 600, and more specifically the easel axis E-E, extends at an oblique angle relative to the rear surface 402 of the frame 400. Stated another way, the easel 600 is coupled to the frame 400 along one of the sides (there are four sides in the exemplified embodiment) of the frame 400. In the use position, the easel 600 extends obliquely from the rear surface 402 of the frame 400 in a direction away from the side to which it is coupled and towards the side of the frame 400 that is opposite the side to which is it coupled. Thus, the easel 600 is angled inwardly towards the interior of the frame. This oblique extension of the easel 600 from the frame 400 assists in achieving the desired tilt angle of the frame 400 when the frame 400 is supported on a horizontal support surface. In some embodiments the easel 600 in the use state extends from the rear surface 402 of the frame at an angle that is between 70° and 80°, and more specifically between 75° and 80°.

Referring to FIGS. 19-22, a frame apparatus 3000 is illustrated in accordance with yet another embodiment of the present invention. The frame apparatus 3000 is similar to the frame apparatus 2000, although there are differences as described herein below. Specifically the frame apparatus 3000 comprises a frame 700, a stack 800, and an easel assembly 900. The most notable difference between the frame apparatus 3000 and the frame apparatus 2000 is that the frame 700 is preferably formed from wood rather than from a plastic material. The other difference is that the easel assembly 900 is a two-component assembly.

The frame 700 comprises a front surface 701 and a rear surface 702 opposite the front surface 701. The frame 700 also comprises an inner surface 703 that defines a display cavity 704 and an outer surface 705 that forms a periphery of the frame 700. In this embodiment, the frame 700 comprises a rabbet 706 for support the stack 800 within the display cavity 704. Thus, as with more traditional frame types, the stack 800 rests atop the rabbet 706 and a fixing device such as a tab, glazier point, turn button, or the like is used to secure the stack 800 within the rabbet 706. In this embodiment, the frame 700 is a rear-loading frame rather than a front loading frame as with the previously described embodiment.

In this embodiment, there is at least one groove 770 formed into the rear surface 702 of the frame 700. More specifically, in the exemplified embodiment there are two of the grooves 770 formed into the rear surface 702 of the frame 700. Each of the grooves 770 comprises a floor 771 and a sidewall 772 extending from the floor 771 to the rear surface 702 of the frame 700. In this embodiment, each of the grooves 770 is a full enclosed depression formed into the rear surface 702 of the frame 700. For example, in the exemplified embodiment each of the grooves 770 has an oval shape. However, the grooves 770 could have other shapes, such as being polygonal shaped or the like and thus the shape of the grooves 770 is not intended to be limiting of the invention in all embodiments. In embodiments whereby the frame 700 is formed from wood, the grooves 770 may be routered into the frame 700 after formation of the frame 700. In other embodiments the grooves 770 may be formed in any desired manner, including integrally with the formation of the frame 700.

The easel assemblies 900 are coupled to the frame 700 within or along the grooves 770. Each of the easel assemblies 900 comprises a plate member 910 that is coupled to the frame 700 and an easel 920 that is pivotably coupled to the plate member 910. The easel 920 may be detachably coupled to the plate member 910 in some embodiments. The plate member 910 is positioned, at least partially, within the groove 770 and then secured to the frame 700 using fasteners 911 such as screws, nails, staples, or the like. In other embodiments, the plate members 910 may be coupled to the frame 700 using adhesive such as glue, tape, or the like.

Figure 21:
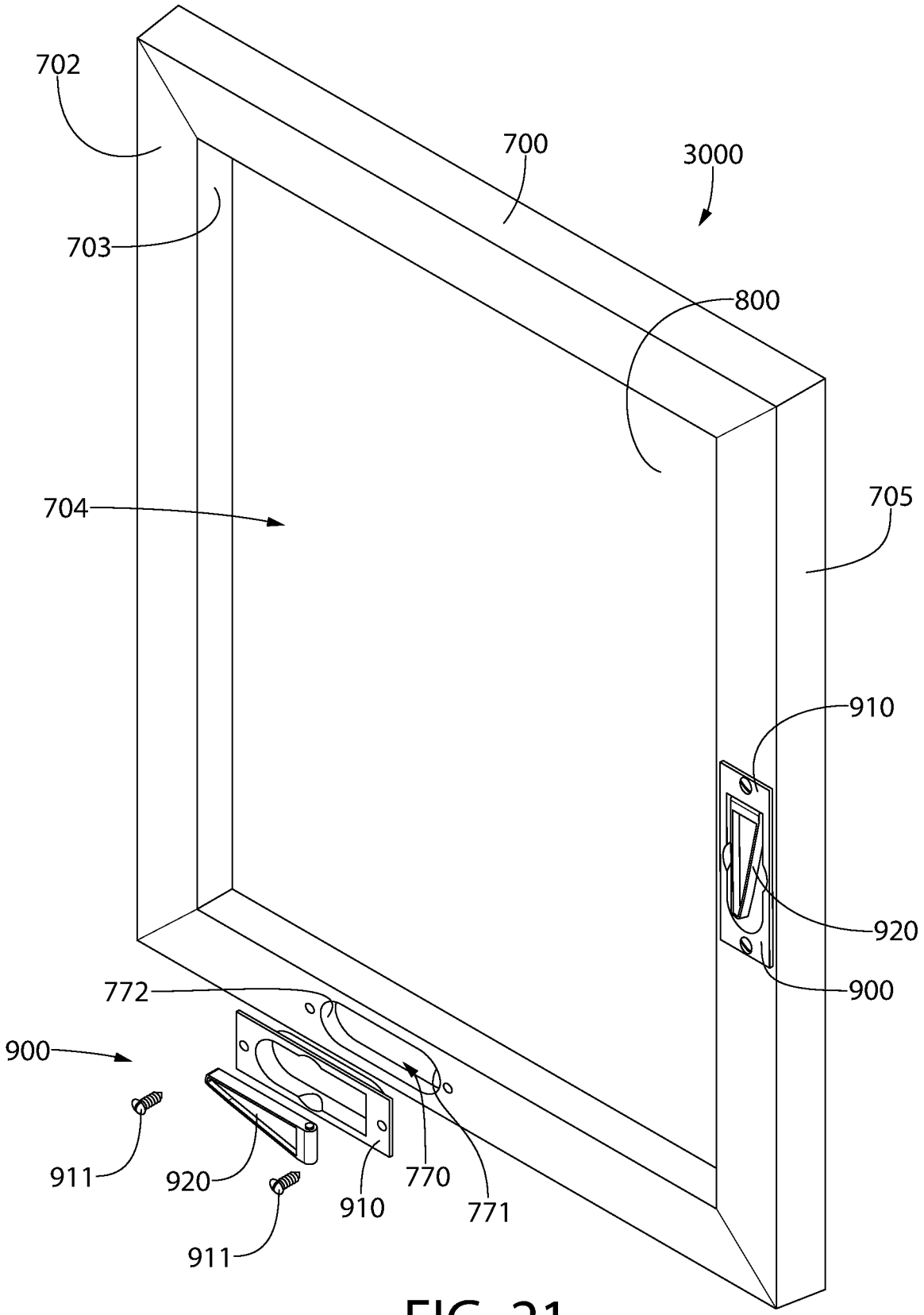
FIG. 21 is a rear perspective view of the frame assembly of FIG. 19 with one of the easel assemblies exploded away from a frame of the frame assembly.
Figure 22:
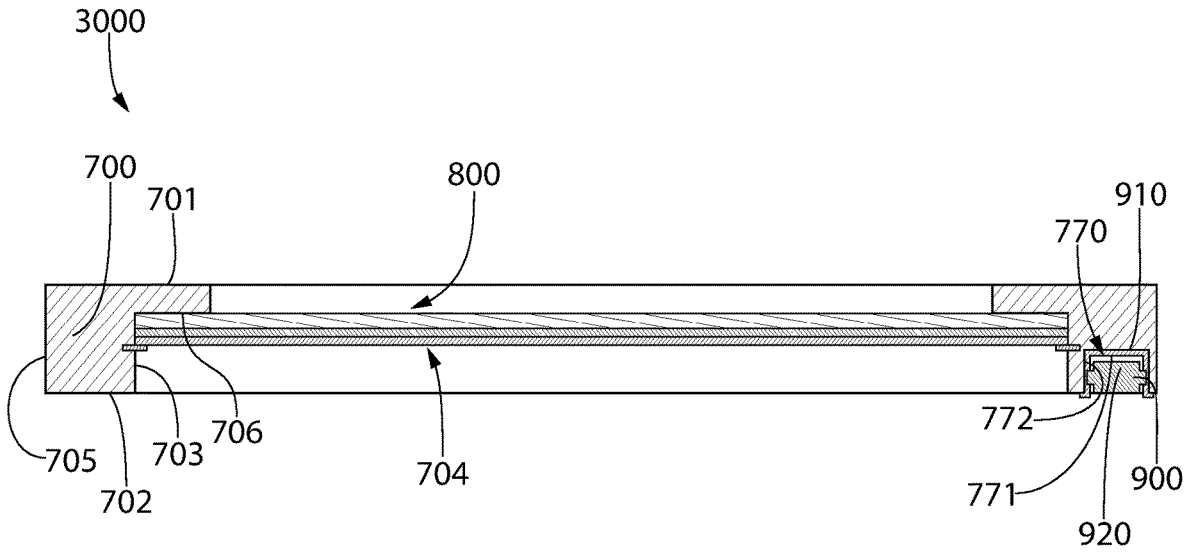
FIG. 22 is a cross-sectional view taken along line XXII-XXII of FIG. 19.

Each of the easels 920 is then coupled to one of the plate members 910 so that the easel 920 can pivot relative to the plate member 910 (and hence also relative to the frame 700 because the plate member 910 is fixedly secured to the frame 700). In the exemplified embodiment, as best shown in FIGS. 21 and 22, the easels 920 comprise male couplers (i.e., protrusions) that are received within female couplers (i.e., recesses) of the plate member 910 to facilitate the pivotable coupling of the easel 920 to the plate member 910. Thus, the easels 920 are able to pivot/rotate relative to the plate members 910 while remaining coupled to the plate members 910 due to the engagement between the male couplers of the easel 920 and the female couplers of the plate member 910. Of course, it should be appreciated that the easel 920 could comprise the female couplers while the plate member 910 comprises the male couplers to achieve the same result.

The easels 920 are configured to pivot relative to the frame 700 and plate members 910 between a storage state wherein the easels 920 are nesting within the grooves 770 and a use state in which the easels 920 protrude or otherwise extend from the rear surface 702 of the frame 700. Thus, FIGS. 19-22 illustrate how an easel assembly 900 can be coupled to a more traditional-style frame such as the frame 700 so that the easel assembly 900 can be used to support the frame assembly 300 on a horizontal support surface. Furthermore, FIGS. 19-22 illustrate a frame 700 that can be converted into the frame assembly 3000 by attaching the easel assemblies 900 to the frame 700 in the manner described herein.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A frame assembly for displaying a flat article, the frame assembly comprising:

a stack comprising a transparent window panel;

a frame comprising:

a floor structure for supporting the stack, the floor structure comprising a floor having an inner edge and an outer edge and an inner annular wall extending upwardly from the inner edge of the floor to a top edge of the inner annular wall, the stack being configured to be positioned atop of and in contact with the top edge of the inner annular wall; and an outer annular wall extending from the outer edge of the floor, the outer annular wall comprising an outer surface defining a periphery of the frame, an inner surface defining a display cavity, and a front edge that defines a display opening, wherein the stack is configured to be positioned within the display cavity via the display opening; and wherein the outer annular wall comprises a thickness measured between the inner and outer surfaces of the outer annular wall, and wherein the thickness of the outer annular wall is non-uniform.

2. The frame assembly according to claim 1 wherein the outer annular wall comprises a plurality of linear wall portions, and wherein the thickness of the outer annular wall is non-uniform along each of the plurality of linear wall portions.

3. The frame assembly according to claim 1 wherein the outer annular wall comprises a plurality of corner portions each comprising a corner of the outer annular wall and a plurality of side portions each extending between two of the corner portions, and wherein the thickness of the outer annular wall is uniform along the side portions and non-uniform along the corner portions.

4. The frame assembly according to claim 3 wherein lower portions of the corner portions of the outer annular wall that are adjacent to the floor have a first thickness and wherein upper portions of the corner portions of the outer annular wall that are adjacent to the front edge of the outer annular wall have a second thickness that is different than the first thickness.

5. The frame assembly according to claim 4 wherein the second thickness is less than the first thickness.

6. The frame assembly according to claim 1 wherein the outer annular wall comprises a plurality of corner portions each comprising a corner of the outer annular wall and a plurality of side portions each extending between two of the corner portions, and wherein the outer annular wall comprises a shoulder located at each transition between one of the side portions and one of the corner portions.

7. The frame assembly according to claim 6 wherein each shoulder extends from the floor towards the front edge of the outer annular wall, and wherein a first portion of the outer annular wall located on a first side of the shoulder has a first thickness and wherein a second portion of the outer annular wall located on a second side of the shoulder has a second thickness that is different from the first thickness.

8. The frame assembly according to claim 6 wherein at least one of the shoulders is formed by a vertical wall that extends perpendicularly from the inner surface of the outer annular wall.

9. The frame assembly according to claim 6 wherein at least one of the shoulders comprises a ramp to taper the thickness of the outer annular wall.

10. The frame assembly according to claim 1 further comprising a locking feature extending from the inner surface of the outer annular wall adjacent to the front edge, wherein the locking feature snap-locks the stack within the display cavity.

11. The frame assembly according to claim 10 wherein the outer annular wall comprises a plurality of corner portions each comprising a corner of the outer annular wall and a plurality of side portions each extending between two of the corner portions, and wherein the locking feature extends along the side portions and does not extend along the corner portions.

12. The frame assembly according to claim 1 wherein the frame is a monolithic structure formed from a hard plastic material.

13. The frame assembly according to claim 12 wherein the frame comprises reinforcement members that are coupled to the top edge of the inner annular wall and extend across the display cavity, the reinforcement members intersecting at a central reinforcement region.

14. A frame assembly for displaying a flat article, the frame assembly comprising:

a frame comprising:

a floor structure comprising a floor having an inner edge and an outer edge and an inner annular wall extending upwardly from the inner edge of the floor and terminating at a top edge; and an outer annular wall extending upwardly from the outer edge of the floor and terminating at a front edge, the outer annular wall comprising an outer surface defining a periphery of the frame and an inner surface defining a display cavity;

wherein the outer annular wall comprises a plurality of corner portions each comprising a corner of the outer annular wall and a plurality of side portions each extending between two of the corner portions; and wherein, along at least one of the corner portions, the outer annular wall comprises a lower portion adjacent to the floor of the floor structure and an upper portion adjacent to the front edge of the outer annular wall, the lower portion having a first thickness and the upper portion having a second thickness, the first thickness being greater than the second thickness.

15. The frame assembly according to claim 14 further comprising a stack comprising a transparent window panel, wherein the stack is configured to be positioned in the display cavity so that a rear surface of the stack is in contact with the top edge of the inner annular wall.

16. The frame assembly according to claim 13 and wherein the inner surface of the outer annular wall comprises a shoulder located at intersections between the corner portions and the side portions.

17. The frame assembly according to claim 14 wherein the inner annular wall has a first height measured from the floor to the top edge of the inner annular wall and the outer annular wall has a second height measured from the floor to the front edge of the outer annular wall, and wherein the second height is greater than the first height.

18. The frame assembly according to claim 14 further comprising a first reinforcement member extending between and connected to two opposing sides of the inner annular wall and a second reinforcement member extending between and connected to two other opposing sides of the inner annular wall, the first and second reinforcement members intersecting at a central reinforcement region that has a circular shape.

19. The frame assembly of claim 14 wherein the outer annular wall comprises a first wall portion, a second wall portion, a third wall portion opposite the first wall portion, and a fourth wall portion opposite the second wall portion, the second and fourth wall portions extending between and connecting the first and third wall portions, and further comprising a locking feature comprising a first protuberance located on the inner surface of the first wall portion of the outer annular wall, a second protuberance located on the inner surface of the second wall portion of the outer annular wall, a third protuberance located on the inner surface of the third wall portion of the outer annular wall, and a fourth protuberance located on the inner surface of the fourth wall portion of the outer annular wall.

20. The frame assembly according to claim 14 wherein the frame is a monolithic structure formed from a hard plastic material.

21. A frame assembly for displaying a flat article, the frame assembly comprising:

a frame comprising:

a floor structure comprising a floor having an inner edge and an outer edge and an inner annular wall extending upwardly from the inner edge; and an outer annular wall extending upwardly from the outer edge of the floor, the outer annular wall comprising an outer surface defining a periphery of the frame and an inner surface defining a display cavity;

wherein the outer annular wall comprises a plurality of corner portions each comprising a corner of the outer annular wall and a plurality of side portions each extending between two of the corner portions; and wherein the inner surface of the outer annular wall comprises a shoulder located at each intersection between one of the plurality of corner portions and one of the plurality of side portions.

* * * * *